US009518452B2

(12) United States Patent
Turley et al.

(10) Patent No.: US 9,518,452 B2
(45) Date of Patent: Dec. 13, 2016

(54) SURGE IMMUNE LINER SETTING TOOL

(71) Applicant: Weatherford Technology Holdings, LLC, Houston, TX (US)

(72) Inventors: Rocky A. Turley, Houston, TX (US); Mike Bock, Montgomery, TX (US); George Givens, Spring, TX (US); Kathleen Cassard, Houston, TX (US); Paul A. Reinhardt, Houston, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 437 days.

(21) Appl. No.: 14/154,392

(22) Filed: Jan. 14, 2014

(65) Prior Publication Data

US 2014/0196912 A1 Jul. 17, 2014

Related U.S. Application Data

(60) Provisional application No. 61/777,920, filed on Mar. 12, 2013, provisional application No. 61/752,301, filed on Jan. 14, 2013.

(51) Int. Cl.
*E21B 43/10* (2006.01)

(52) U.S. Cl.
CPC ..... *E21B 43/10* (2013.01)

(58) Field of Classification Search
CPC ..... E21B 43/10
See application file for complete search history.

(56) References Cited

U.S. PATENT DOCUMENTS 5,462,121 A 10/1995 Schmuck et al.
5,582,253 A 12/1996 Fraser
5,628,366 A 5/1997 Telfer
6,065,536 A 5/2000 Gudmestad et al.
6,230,801 B1 5/2001 Hill, Jr. et al.
6,408,945 B1 6/2002 Telfer
(Continued)

FOREIGN PATENT DOCUMENTS

GB 2401129 11/2004
WO WO-0077431 A2 12/2000

OTHER PUBLICATIONS

Australian Patent Examination Report dated Mar. 8, 2016, for Australian Patent Application No. 2014205066.
(Continued)

*Primary Examiner* — David Andrews
(74) *Attorney, Agent, or Firm* — Patterson & Sheridan, LLP

(57) ABSTRACT

A setting tool for hanging a tubular string includes: a tubular mandrel having an actuation port formed through a wall thereof; a debris barrier for engaging an upper end of the tubular string; and a piston having an upper face in fluid communication with the actuation port. The setting tool further includes: an actuator sleeve extending along the mandrel and connected to the piston; a latch releasably connecting the debris barrier to the actuator sleeve and for releasably connecting the debris barrier to the tubular string; a packoff connected to the mandrel below the piston and operable to seal against an inner surface of the tubular string, thereby forming a buffer chamber between the debris barrier and the packoff; and a passage. The passage: is in fluid communication with a lower face of the piston, is formed in a wall of and along the mandrel, and bypasses the packoff.

27 Claims, 11 Drawing Sheets

(56) References Cited

U.S. PATENT DOCUMENTS

| | | | | |
|---|---|---|---|---|
| 6,453,996 | B1 | 9/2002 | Carmichael et al. | |
| 7,048,055 | B2 | 5/2006 | Hirth | |
| 7,114,573 | B2 | 10/2006 | Hirth et al. | |
| 7,225,870 | B2 | 6/2007 | Pedersen et al. | |
| 7,766,088 | B2 | 8/2010 | Saucier et al. | |
| 2004/0221984 | A1 | 11/2004 | Cram | |
| 2011/0108266 | A1 | 5/2011 | Smith et al. | |
| 2012/0181048 | A1 | 7/2012 | Reinhardt et al. | |
| 2012/0205091 | A1 | 8/2012 | Turley et al. | |
| 2012/0205092 | A1 | 8/2012 | Givens et al. | |
| 2013/0319691 | A1 | 12/2013 | Thomson et al. | |
| 2014/0318765 | A1* | 10/2014 | Jordy | E21B 43/10 166/236 |
| 2015/0136393 | A1 | 5/2015 | Turley et al. | |

OTHER PUBLICATIONS

PCT International Search Report and Written Opinion dated Jul. 2, 2015, for International Application No. PCT/US2014/011504.
PCT Partial Search Report dated Apr. 8, 2015, for International Application No. PCT/US2014/011504.
Canadian Office Action dated Jun. 17, 2016, for Canadian Patent Application No. 2,895,809.

* cited by examiner

SURGE IMMUNE LINER SETTING TOOL

BACKGROUND OF THE DISCLOSURE

Field of the Disclosure

The present disclosure generally relates to a surge immune liner setting tool.

Description of the Related Art

A wellbore is formed to access hydrocarbon bearing formations, e.g. crude oil and/or natural gas, or geothermal formations by the use of drilling. Drilling is accomplished by utilizing a drill bit that is mounted on the end of a tubular string, such as a drill string. To drill within the wellbore to a predetermined depth, the drill string is often rotated by a top drive or rotary table on a surface platform or rig, and/or by a downhole motor mounted towards the lower end of the drill string. After drilling to a predetermined depth, the drill string and drill bit are removed and a section of casing is lowered into the wellbore. An annulus is thus formed between the string of casing and the formation. The casing string is cemented into the wellbore by circulating cement into the annulus defined between the outer wall of the casing and the borehole. The combination of cement and casing strengthens the wellbore and facilitates the isolation of certain areas of the formation behind the casing for the production of hydrocarbons.

It is common to employ more than one string of casing or liner in a wellbore. In this respect, the well is drilled to a first designated depth with a drill bit on a drill string. The drill string is removed. A first string of casing is then run into the wellbore and set in the drilled out portion of the wellbore, and cement is circulated into the annulus behind the casing string. Next, the well is drilled to a second designated depth, and a second string of casing or liner, is run into the drilled out portion of the wellbore. If the second string is a liner string, the liner is set at a depth such that the upper portion of the second string of casing overlaps the lower portion of the first string of casing. The liner string may then be hung off of the existing casing. The second casing or liner string is then cemented. This process is typically repeated with additional casing or liner strings until the well has been drilled to total depth. In this manner, wells are typically formed with two or more strings of casing/liner of an ever-decreasing diameter.

The liner string is typically deployed to a desired depth in the wellbore using a workstring. A setting tool of the liner string is then operated to set a hanger of the liner string against a previously installed casing string. The liner hanger may include slips riding outwardly on cones in order to frictionally engage the surrounding casing string. The setting tool is typically operated by pumping a ball through the workstring to a seat located below the setting tool. Pressure is exerted on the seated ball to operate the setting tool. Such a setting tool may limit operational flexibility in deploying the liner string as a pressure surge could unintentionally operate the setting tool before the liner string has reached the desired depth.

SUMMARY OF THE DISCLOSURE

The present disclosure generally relates to a surge immune liner setting tool. In one embodiment, a setting tool for hanging a tubular string from a liner string, casing string, or wellhead includes: a tubular mandrel having an actuation port formed through a wall thereof; a debris barrier for engaging an upper end of the tubular string; and a piston. The piston: is disposed along the mandrel, has an upper face in fluid communication with the actuation port, and is operable to stroke the debris barrier relative to the mandrel, thereby setting a hanger of the tubular string. The setting tool further includes: an actuator sleeve extending along the mandrel and connected to the piston; a latch releasably connecting the debris barrier to the actuator sleeve and for releasably connecting the debris barrier to the tubular string; a packoff connected to the mandrel below the piston and operable to seal against an inner surface of the tubular string, thereby forming a buffer chamber between the debris barrier and the packoff; and a passage. The passage: is in fluid communication with a lower face of the piston, is formed in a wall of and along the mandrel, and bypasses the packoff.

In another embodiment, a method of hanging a tubular string from a liner string, casing string, or wellhead, includes running the tubular string into a wellbore using a deployment string and a deployment assembly. The deployment assembly includes a seat and a setting tool having: a debris barrier closing an upper end of the tubular string, a packoff sealing an interface between the setting tool and the tubular string, an actuator piston having an upper face in communication with a bore of the setting tool and a lower face in communication with the interface below the packoff, a latch releasably connecting the piston to the debris barrier and releasably connecting the debris barrier to the tubular string, and a packer actuator associated with the packoff. The method further includes: pumping a setting plug to the seat, thereby operating the piston to set a hanger of the tubular string, wherein the latch releases the debris barrier from the actuator piston after setting the hanger; after setting the hanger, raising the setting tool from the tubular string, thereby operating the latch to release the debris barrier from the tubular string and extending the packer actuator against the upper end; and after raising the setting tool, setting weight on the packer actuator and upper end, thereby setting a packer of the tubular string.

In another embodiment, a setting tool for hanging a tubular string from a liner string, casing string, or wellhead, includes: a tubular mandrel having an actuation port formed through a wall thereof; a debris barrier for engaging an upper end of the tubular string; a latch for engaging a profile formed in an inner surface of the tubular string and operable to release the tubular string in response to a threshold force; and a piston. The piston: is disposed along the mandrel, has an upper face in fluid communication with the actuation port, and is operable to stroke the latch relative to the mandrel, thereby setting a hanger of the tubular string. The setting tool further includes a packoff connected to the mandrel above the piston and operable to seal against an inner surface of the tubular string, thereby forming a buffer chamber between the debris barrier and the packoff.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only typical embodiments of this disclosure and are therefore not to be considered limiting of its scope, for the disclosure may admit to other equally effective embodiments.

DETAILED DESCRIPTION

Figure 1A:
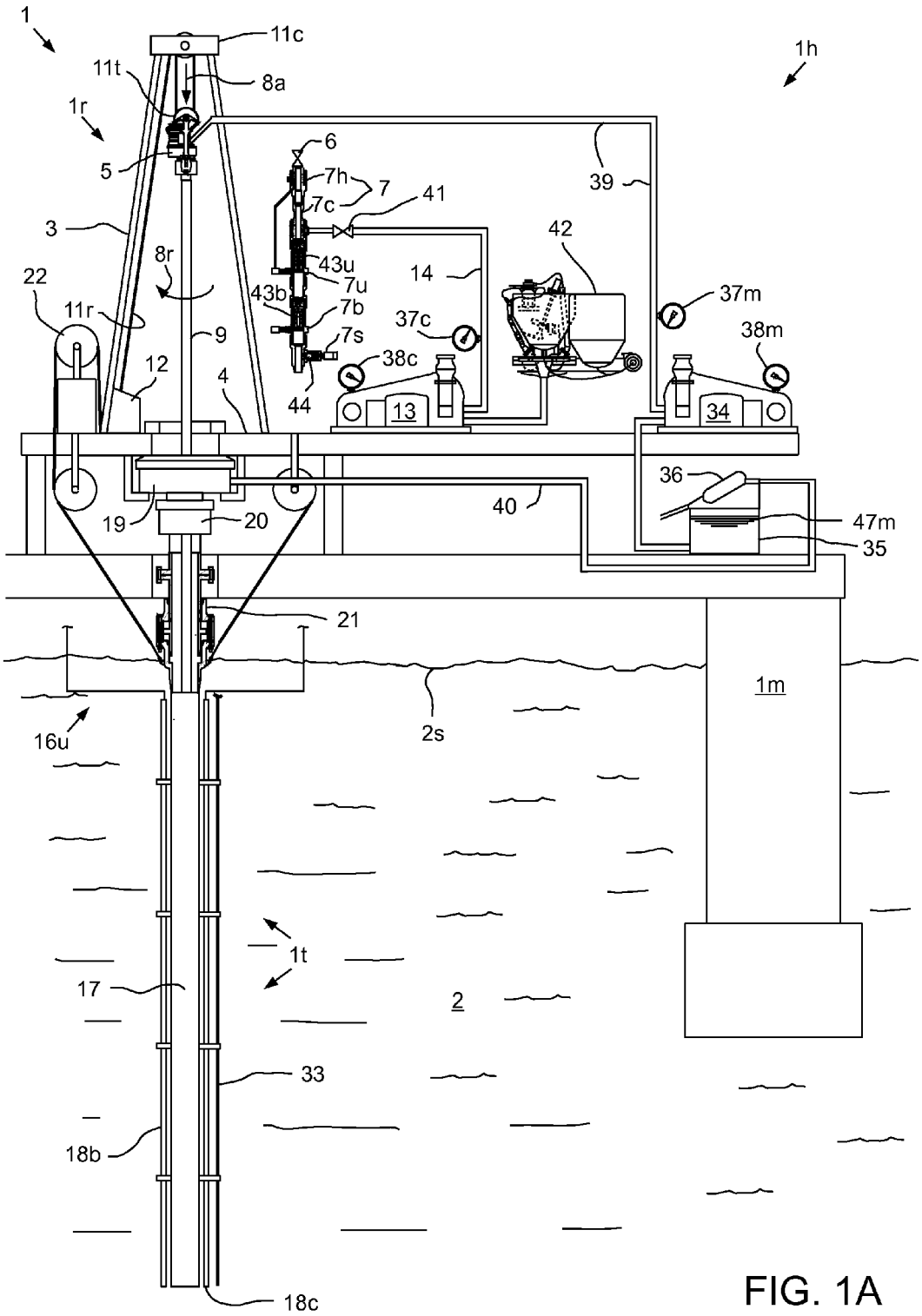
FIGS. 1A-1C illustrate a drilling system in a liner deployment mode, according to one embodiment of this disclosure.
Figure 1B:
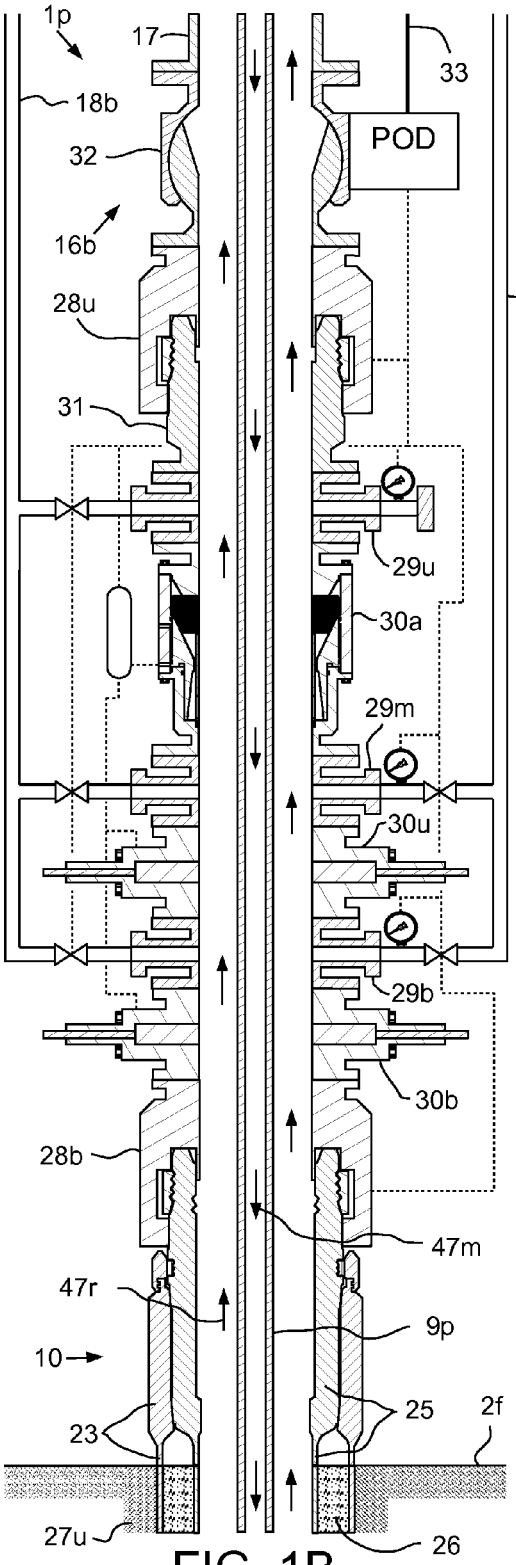
Figure 1C:
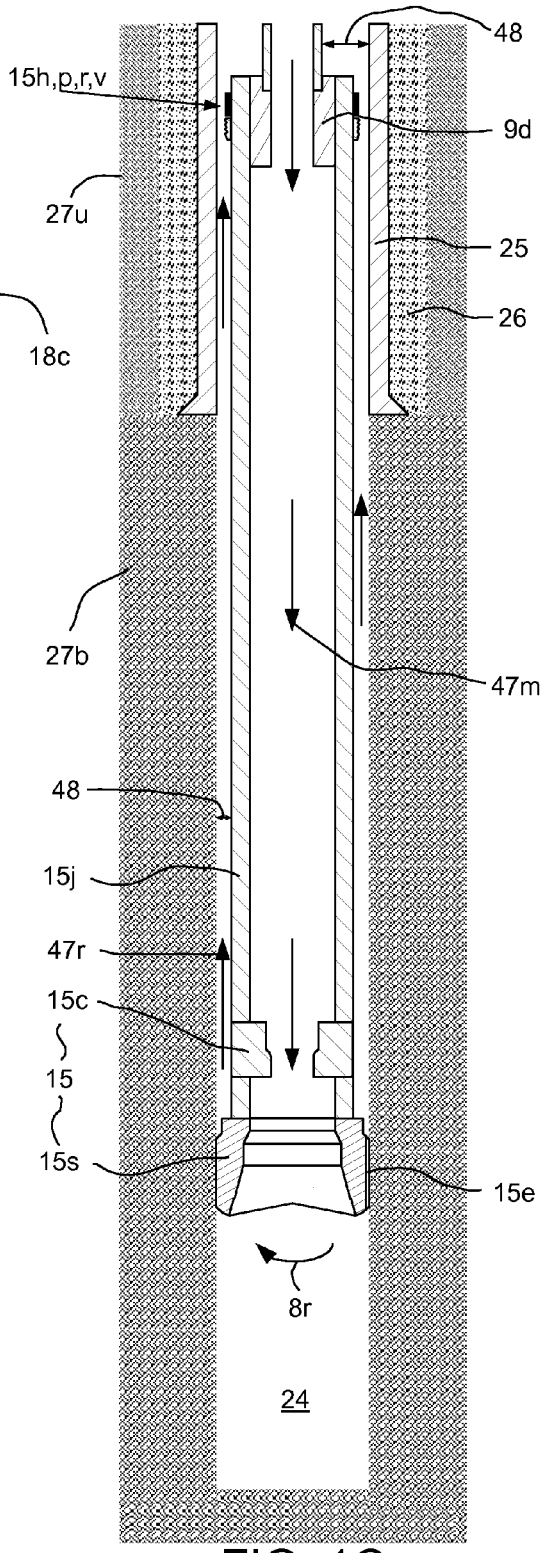

FIGS. 1A-1C illustrate a drilling system 1 in a liner deployment mode, according to one embodiment of this disclosure. The drilling system 1 may include a mobile offshore drilling unit (MODU) 1*m*, such as a semi-submersible, a drilling rig 1*r*, a fluid handling system 1*h*, a fluid transport system 1*t*, a pressure control assembly (PCA) 1*p*, and a workstring 9.

The MODU 1*m* may carry the drilling rig 1*r* and the fluid handling system 1*h* aboard and may include a moon pool, through which drilling operations are conducted. The semi-submersible MODU 1*m* may include a lower barge hull which floats below a surface (aka waterline) 2*s* of sea 2 and is, therefore, less subject to surface wave action. Stability columns (only one shown) may be mounted on the lower barge hull for supporting an upper hull above the waterline. The upper hull may have one or more decks for carrying the drilling rig 1*r* and fluid handling system 1*h*. The MODU 1*m* may further have a dynamic positioning system (DPS) (not shown) or be moored for maintaining the moon pool in position over a subsea wellhead 10.

Alternatively, the MODU may be a drill ship. Alternatively, a fixed offshore drilling unit or a non-mobile floating offshore drilling unit may be used instead of the MODU. Alternatively, the wellbore may be subsea having a wellhead located adjacent to the waterline and the drilling rig may be a located on a platform adjacent the wellhead. Alternatively, the wellbore may be subterranean and the drilling rig located on a terrestrial pad.

The drilling rig 1*r* may include a derrick 3, a floor 4, a top drive 5, a cementing head 7, and a hoist. The top drive 5 may include a motor for rotating 8*r* the workstring 9. The top drive motor may be electric or hydraulic. A frame of the top drive 5 may be linked to a rail (not shown) of the derrick 3 for preventing rotation thereof during rotation of the workstring 9 and allowing for vertical movement of the top drive with a traveling block 11*t* of the hoist. The frame of the top drive 5 may be suspended from the derrick 3 by the traveling block 11*t*. The quill may be torsionally driven by the top drive motor and supported from the frame by bearings. The top drive may further have an inlet connected to the frame and in fluid communication with the quill. The traveling block 11*t* may be supported by wire rope 11*r* connected at its upper end to a crown block 11*c*. The wire rope 11*r* may be woven through sheaves of the blocks 11*c,t* and extend to drawworks 12 for reeling thereof, thereby raising or lowering the traveling block 11*t* relative to the derrick 3. The drilling rig 1*r* may further include a drill string compensator (not shown) to account for heave of the MODU 1*m*. The drill string compensator may be disposed between the traveling block 11*t* and the top drive 5 (aka hook mounted) or between the crown block 11*c* and the derrick 3 (aka top mounted).

Alternatively, a Kelly and rotary table may be used instead of the top drive.

In the deployment mode, an upper end of the workstring 9 may be connected to the top drive quill, such as by threaded couplings. The workstring 9 may include a liner deployment assembly (LDA) 9*d* and a deployment string, such as joints of drill pipe 9*p* connected together, such as by threaded couplings. An upper end of the LDA 9*d* may be connected a lower end of the drill pipe 9*p*, such as by threaded couplings. The LDA 9*d* may also be connected to a liner string 15. The liner string 15 may include a polished bore receptacle (PBR) 15*r*, a packer 15*p*, a liner hanger 15*h*, a body 15*v* for carrying the hanger and packer (HP body), joints of liner 15*j*, a landing collar 15*c*, and a reamer shoe 15*s*. The HP body 15*v*, liner joints 15*j*, landing collar 15*c*, and reamer shoe 15*s* may be interconnected, such as by threaded couplings. The reamer shoe 15*s* may be rotated 8*r* by the top drive 5 via the workstring 9.

Alternatively, drilling fluid may be injected into the liner string 15 during deployment thereof. Alternatively, drilling fluid may be injected into the liner string 15 and the liner string may include a drillable drill bit (not shown) instead of the reamer shoe 15*s* and the liner string may be drilled into the lower formation 27*b*, thereby extending the wellbore 24 while deploying the liner string.

Once liner deployment has concluded, the workstring 9 may be disconnected from the top drive 5 and the cementing head 7 may be inserted and connected therebetween. The cementing head 7 may include an isolation valve 6, an actuator swivel 7*h*, a cementing swivel 7*c*, and one or more plug launchers, such as a top dart launcher 7*u*, a bottom dart launcher 7*b*, and a ball launcher 7*s*. The isolation valve 6 may be connected to a quill of the top drive 5 and an upper end of the actuator swivel 7*h*, such as by threaded couplings. An upper end of the workstring 9 may be connected to a lower end of the cementing head 7, such as by threaded couplings.

The cementing swivel 7*c* may include a housing torsionally connected to the derrick 3, such as by bars, wire rope, or a bracket (not shown). The torsional connection may accommodate longitudinal movement of the swivel 7*c* relative to the derrick 3. The cementing swivel 7*c* may further include a mandrel and bearings for supporting the housing from the mandrel while accommodating rotation 8*r* of the mandrel. An upper end of the mandrel may be connected to a lower end of the actuator swivel, such as by threaded couplings. The cementing swivel 7*c* may further include an inlet formed through a wall of the housing and in fluid communication with a port formed through the mandrel and a seal assembly for isolating the inlet-port communication. The cementing mandrel port may provide fluid communication between a bore of the cementing head and the housing inlet. The seal assembly may include one or more stacks of V-shaped seal rings, such as opposing stacks, disposed between the mandrel and the housing and straddling the inlet-port interface. The actuator swivel 7*h* may be similar to the cementing swivel 7*c* except that the housing may have three inlets in fluid communication with respective passages formed through the mandrel. The mandrel passages may extend to respective outlets of the mandrel for connection to respective hydraulic conduits (only one shown) for operating respective hydraulic actuators of the plug launchers 7*u,b,s*. The actuator swivel inlets may be in fluid communication with a hydraulic power unit (HPU, not shown).

Alternatively, the seal assembly may include rotary seals, such as mechanical face seals.

Each dart launcher 7*u,b* may include a body, a diverter, a canister, a latch, and the actuator. Each body may be tubular and may have a bore therethrough. To facilitate assembly, each body may include two or more sections connected together, such as by threaded couplings. An upper end of the top dart launcher body may be connected to a lower end of the actuator swivel 7*h*, such as by threaded couplings and a lower end of the bottom dart launcher body may be connected to the workstring 9. Each body may further have a landing shoulder formed in an inner surface thereof. Each canister and diverter may each be disposed in the respective body bore. Each diverter may be connected to the respective body, such as by threaded couplings. Each canister may be longitudinally movable relative to the respective body. Each canister may be tubular and have ribs formed along and around an outer surface thereof. Bypass passages may be formed between the ribs. Each canister may further have a landing shoulder formed in a lower end thereof corresponding to the respective body landing shoulder. Each diverter may be operable to deflect fluid received from a cement line 14 away from a bore of the respective canister and toward the bypass passages. A release plug, such as a top dart 43*u* or a bottom dart 43*b*, may be disposed in the respective canister bore.

Each latch may include a body, a plunger, and a shaft. Each latch body may be connected to a respective lug formed in an outer surface of the respective launcher body, such as by threaded couplings. Each plunger may be longitudinally movable relative to the respective latch body and radially movable relative to the respective launcher body between a capture position and a release position. Each plunger may be moved between the positions by interaction, such as a jackscrew, with the respective shaft. Each shaft may be longitudinally connected to and rotatable relative to the respective latch body. Each actuator may be a hydraulic motor operable to rotate the shaft relative to the latch body.

The ball launcher 7*s* may include a body, a plunger, an actuator, and a setting plug, such as a ball 44, loaded therein. The ball launcher body may be connected to another lug formed in an outer surface of the dart launcher body, such as by threaded couplings. The ball 44 may be disposed in the plunger for selective release and pumping downhole through the drill pipe 9*p* to the LDA 9*d*. The plunger may be movable relative to the launcher body between a captured position and a release position. The plunger may be moved between the positions by the actuator. The actuator may be hydraulic, such as a piston and cylinder assembly.

Alternatively, the actuator swivel and launcher actuators may be pneumatic or electric. Alternatively, the dart launcher actuators may be linear, such as piston and cylinders.

In operation, when it is desired to launch one of the plugs 43*u,b*, 44 the HPU may be operated to supply hydraulic fluid to the appropriate launcher actuator via the actuator swivel 7*h*. The selected launcher actuator may then move the plunger to the release position (not shown). If one of the dart launchers 7*u,b* is selected, the respective canister and dart 43*u,b* may then move downward relative to the body until the landing shoulders engage. Engagement of the landing shoulders may close the respective canister bypass passages, thereby forcing fluid to flow into the canister bore. The fluid may then propel the respective dart 43*u,b* from the canister bore into a lower bore of the body and onward through the workstring 9. If the ball launcher 7*s* was selected, the plunger may carry the ball 44 into the lower dart launcher body to be propelled into the drill pipe 9*p* by the fluid.

The fluid transport system 1*t* may include an upper marine riser package (UMRP) 16*u*, a marine riser 17, a booster line 18*b*, and a choke line 18*c*. The riser 17 may extend from the PCA 1*p* to the MODU 1*m* and may connect to the MODU via the UMRP 16*u*. The UMRP 16*u* may include a diverter 19, a flex joint 20, a slip (aka telescopic) joint 21, and a tensioner 22. The slip joint 21 may include an outer barrel connected to an upper end of the riser 17, such as by a flanged connection, and an inner barrel connected to the flex joint 20, such as by a flanged connection. The outer barrel may also be connected to the tensioner 22, such as by a tensioner ring.

The flex joint 20 may also connect to the diverter 21, such as by a flanged connection. The diverter 21 may also be connected to the rig floor 4, such as by a bracket. The slip joint 21 may be operable to extend and retract in response to heave of the MODU 1*m* relative to the riser 17 while the tensioner 22 may reel wire rope in response to the heave, thereby supporting the riser 17 from the MODU 1*m* while accommodating the heave. The riser 17 may have one or more buoyancy modules (not shown) disposed therealong to reduce load on the tensioner 22.

The PCA 1*p* may be connected to the wellhead 10 located adjacent to a floor 2*f* of the sea 2. A conductor string 23 may be driven into the seafloor 2*f*. The conductor string 23 may include a housing and joints of conductor pipe connected together, such as by threaded couplings. Once the conductor string 23 has been set, a subsea wellbore 24 may be drilled into the seafloor 2*f* and a casing string 25 may be deployed into the wellbore. The casing string 25 may include a wellhead housing and joints of casing connected together, such as by threaded couplings. The wellhead housing may land in the conductor housing during deployment of the casing string 25. The casing string 25 may be cemented 26 into the wellbore 24. The casing string 25 may extend to a depth adjacent a bottom of the upper formation 27*u*. The wellbore 24 may then be extended into the lower formation 27*b* using a pilot bit and underreamer (not shown).

The upper formation 27*u* may be non-productive and a lower formation 27*b* may be a hydrocarbon-bearing reservoir. Alternatively, the lower formation 27*b* may be non-productive (e.g., a depleted zone), environmentally sensitive, such as an aquifer, or unstable.

The PCA 1*p* may include a wellhead adapter 28*b*, one or more flow crosses 29*u,m,b*, one or more blow out preventers (BOPs) 30*a,u,b*, a lower marine riser package (LMRP) 16*b*, one or more accumulators, and a receiver 31. The LMRP 16*b* may include a control pod, a flex joint 32, and a connector 28*u*. The wellhead adapter 28*b*, flow crosses 29*u,m,b*, BOPs 30*a,u,b*, receiver 31, connector 28*u*, and flex joint 32, may each include a housing having a longitudinal bore therethrough and may each be connected, such as by flanges, such that a continuous bore is maintained therethrough. The flex joints 21, 32 may accommodate respective horizontal and/or rotational (aka pitch and roll) movement of the MODU 1*m* relative to the riser 17 and the riser relative to the PCA 1*p*.

Each of the connector 28*u* and wellhead adapter 28*b* may include one or more fasteners, such as dogs, for fastening the LMRP 16*b* to the BOPs 30*a,u,b* and the PCA 1*p* to an external profile of the wellhead housing, respectively. Each of the connector 28*u* and wellhead adapter 28*b* may further include a seal sleeve for engaging an internal profile of the respective receiver 31 and wellhead housing. Each of the connector 28*u* and wellhead adapter 28*b* may be in electric or hydraulic communication with the control pod and/or further include an electric or hydraulic actuator and an interface, such as a hot stab, so that a remotely operated subsea vehicle (ROV) (not shown) may operate the actuator for engaging the dogs with the external profile.

The LMRP 16*b* may receive a lower end of the riser 17 and connect the riser to the PCA 1*p*. The control pod may be in electric, hydraulic, and/or optical communication with a rig controller (not shown) onboard the MODU 1*m* via an umbilical 33. The control pod may include one or more control valves (not shown) in communication with the BOPs 30*a,u,b* for operation thereof. Each control valve may include an electric or hydraulic actuator in communication with the umbilical 33. The umbilical 33 may include one or more hydraulic and/or electric control conduit/cables for the actuators. The accumulators may store pressurized hydraulic fluid for operating the BOPs 30*a,u,b*. Additionally, the accumulators may be used for operating one or more of the other components of the PCA 1*p*. The control pod may further include control valves for operating the other functions of the PCA 1*p*. The rig controller may operate the PCA 1*p* via the umbilical 33 and the control pod.

A lower end of the booster line 18*b* may be connected to a branch of the flow cross 29*u* by a shutoff valve. A booster manifold may also connect to the booster line lower end and have a prong connected to a respective branch of each flow cross 29*m,b*. Shutoff valves may be disposed in respective prongs of the booster manifold. Alternatively, a separate kill line (not shown) may be connected to the branches of the flow crosses 29*m,b* instead of the booster manifold. An upper end of the booster line 18*b* may be connected to an outlet of a booster pump (not shown). A lower end of the choke line 18*c* may have prongs connected to respective second branches of the flow crosses 29*m,b*. Shutoff valves may be disposed in respective prongs of the choke line lower end.

A pressure sensor may be connected to a second branch of the upper flow cross 29*u*. Pressure sensors may also be connected to the choke line prongs between respective shutoff valves and respective flow cross second branches. Each pressure sensor may be in data communication with the control pod. The lines 18*b,c* and umbilical 33 may extend between the MODU 1*m* and the PCA 1*p* by being fastened to brackets disposed along the riser 17. Each shutoff valve may be automated and have a hydraulic actuator (not shown) operable by the control pod.

Alternatively, the umbilical may be extended between the MODU and the PCA independently of the riser. Alternatively, the shutoff valve actuators may be electrical or pneumatic.

The fluid handling system 1*h* may include one or more pumps, such as a cement pump 13 and a mud pump 34, a reservoir for drilling fluid 47*m*, such as a tank 35, a solids separator, such as a shale shaker 36, one or more pressure gauges 37*c,m*, one or more stroke counters 38*c,m*, one or more flow lines, such as cement line 14, mud line 39, and return line 40, a cement mixer 42, and one or more tag launchers 44*a,b*. The drilling fluid 47*m* may include a base liquid. The base liquid may be refined or synthetic oil, water, brine, or a water/oil emulsion. The drilling fluid 47*m* may further include solids dissolved or suspended in the base liquid, such as organophilic clay, lignite, and/or asphalt, thereby forming a mud.

A first end of the return line 40 may be connected to the diverter outlet and a second end of the return line may be connected to an inlet of the shaker 36. A lower end of the mud line 39 may be connected to an outlet of the mud pump 34 and an upper end of the mud line may be connected to the top drive inlet. The pressure gauge 37*m* may be assembled as part of the mud line 39. An upper end of the cement line 14 may be connected to the cementing swivel inlet and a lower end of the cement line may be connected to an outlet of the cement pump 13. The shutoff valve 41 and the pressure gauge 37*c* may be assembled as part of the cement line 14. A lower end of a mud supply line may be connected to an outlet of the mud tank 35 and an upper end of the mud supply line may be connected to an inlet of the mud pump 34. An upper end of a cement supply line may be connected to an outlet of the cement mixer 42 and a lower end of the cement supply line may be connected to an inlet of the cement pump 13.

The workstring 9 may be rotated 8*r* by the top drive 5 and lowered 8*a* by the traveling block 11*t*, thereby reaming the liner string 15 into the lower formation 27*b*. Drilling fluid 47*m* may be pumped into the workstring bore by the mud pump 34 via the mud line 39 and top drive 5. The drilling fluid 47*m* may flow down the workstring bore and the liner string bore and be discharged by the reamer shoe 15*s* into an annulus 48 formed between the workstring 9/liner string 15 and the casing string 25/wellbore 24, where the fluid may circulate cuttings away from the shoe. The returns 47*r* (drilling fluid plus cuttings) may flow up the annulus 48 and exit the wellbore 24 and flow into an annulus formed between the riser 17 and the drill pipe 9*p* via an annulus of the LMRP 16*b*, BOP stack, and wellhead 10. The returns 47*r* may exit the riser annulus and enter the return line 40 via an annulus of the UMRP 16*u* and the diverter 19. The returns 47*r* may flow through the return line 40 and into the shale shaker inlet. The returns 47*r* may be processed by the shale shaker 36 to remove the cuttings.

FIGS. 2A-2D illustrate the liner deployment assembly LDA 9*d*. The PBR 15*r*, packer 15*p*, and an upper portion of the liner hanger 15*h* may be longitudinally movable relative to the HP body 15*v* for setting of the packer and liner hanger. A lower end of the packer 15*p* may be linked to an upper end of the liner hanger 15*h* by a thrust bearing 15*b* to longitudinally connect a lower portion of the packer and the hanger upper portion in a downward direction while allowing relative rotation therebetween. The packer lower portion may also be linked to the HP body 15*v* by a pin and slot connection 15*n* to allow relative longitudinal movement therebetween while retaining a torsional connection.

A lower end of the liner hanger 15*h* may be fastened to the HP body 15*v*, such as by an emergency release connection 15*o* to longitudinally and torsionally connect the hanger lower portion to the HP body unless an emergency release maneuver is performed. An upper portion of the packer 15*p* may be linked to the HP body 15*v* by an upper ratchet connection 15*k* and a lower portion of the packer 15*p* may be linked to the HP body by a lower ratchet connection 15*m*. Each ratchet connection 15*k,m* may include a ratchet and a profile of complementing teeth to allow downward movement of the respective packer portion relative to the HP body 15*v* while preventing upward movement of the respective packer portion relative to the HP body.

The hanger upper portion may initially be fastened to the HP body 15*v* by a shearable fastener 15*y* to prevent premature setting of the liner hanger 15*h*. The packer upper portion may also be linked to the HP body 15*v* by a releasable connection 15*x,w* to allow relative longitudinal movement therebetween while retaining a torsional connection. The releasable connection 15*x,w* may maintain the torsional connection until a stroke of the connection is reached. The releasable connection 15*x,w* may include a slot 15*w* formed in an outer surface of the HP body 15*v* and a shearable fastener 15*x* carried by the packer 15*p* and extending into the slot. The releasable connection 15*x,w* may be stroked when the shearable fastener 15*x* engages a bottom of the slot 15*w* and the connection may be released by a threshold force on the packer upper portion to fracture the shearable fastener 15*x*. The slip joint stroke length may correspond to a setting length of the liner hanger 15*h*, such as being slightly greater than. The threshold force may be nominal.

The packer 15*p* may include an adapter, a setting sleeve, a retaining sleeve, a packing element, a wedge, and a ratchet sleeve. An upper end of the adapter may be connected to a lower end of the PBR 15*r*, such as by threaded couplings. An upper end of the setting sleeve may be connected to the lower end of the adapter, such as by threaded couplings. An upper end of the retaining sleeve may be connected to the lower end of the setting sleeve, such as by threaded couplings. The packing element may include a metallic gland, an inner seal, and one or more (two shown) outer seals. The gland may have a groove formed in an outer surface thereof for receiving each outer seal. Each outer seal may include a seal ring, such as an S-ring, and a pair of anti-extrusion elements, such as garter springs. The inner seal may be an o-ring carried in a groove formed in an inner surface of the gland to isolate an interface formed between the gland and the wedge.

The gland inner surface may be tapered having an inclination complementary to an outer surface of the wedge and the gland may be engaged with an upper tip of the wedge. The gland may have cutouts formed in an inner surface thereof to facilitate expansion of the packing element into engagement with the casing 25 (FIG. 6J) and a latch groove formed in the inner surface at an upper end thereof for receiving the retaining sleeve. The retaining sleeve may have an upper base portion and collet fingers extending from the base portion to a lower end thereof. Each collet finger may have a lug formed at a lower end thereof engaged with the retaining sleeve latch groove, thereby fastening the retaining sleeve to the packing element. The collet fingers may be cantilevered from the base portion and have a stiffness urging the lugs toward an engaged position with the latch groove. The HP body 15*v* may carry a seal in an outer surface thereof for sealing an interface formed between the HP body and the wedge. An upper end of the ratchet sleeve may be connected to a lower end of the wedge, such as by threaded couplings.

The liner hanger 15*h* may include a thrust sleeve, a cone, and a plurality of slips. The ratchet sleeve and the thrust sleeve may be linked by the thrust bearing 15*b*. An upper end of the cone may be connected to a lower end of the thrust sleeve, such as by threaded couplings. Each slip may be radially movable between an extended position (FIG. 6B) and a retracted position (shown) by longitudinal movement of the cone relative to the slips. A pocket may be formed in an outer surface of the cone for receiving each slip. Each slip pocket may have an inclined outer surface for extending a respective slip. Each slip may have an inclined inner surface complementary to the slip pocket surface. Each slip may have a groove formed in an outer surface at a lower end thereof. A biasing member, such as a split band 15*d*, may extend through the grooves and have a stiffness urging the slips toward the retracted position. Each slip may have teeth formed along an outer surface thereof and be made from a hard material, such as tool steel, ceramic, or cermet, for engaging and penetrating an inner surface of the casing 25, thereby anchoring the liner string 15 to the casing.

The LDA 9*d* may include a setting tool 52, a running tool 53, a catcher 54, and a plug release system 55. An upper end of the setting tool 52 may be connected to a lower end the drill pipe 9*p*, such as by threaded couplings. A lower end of the setting tool 52 may be fastened to an upper end of the running tool 53. The running tool 53 may also be fastened to the HP body 15*v*. An upper end of the catcher 54 may be connected to a lower end of the running tool 53 and a lower end of the catcher may be connected to an upper end of the plug release system 55, such as by threaded couplings.

A debris barrier 51 of the setting tool 52 may be engaged with and close an upper end of the PBR 15*r*, thereby forming an upper end of a buffer chamber 57*b*. A lower end of the buffer chamber 57*b* may be formed by a sealed interface between a packoff 56 of the setting tool 52 and the PBR 15*r*. The buffer chamber 57*b* may be filled with a buffer fluid 82, such as fresh water, refined/synthetic oil, or other liquid. The buffer chamber 57*b* may prevent infiltration of debris from the wellbore 24 from obstructing operation of the LDA 9*d*.

FIGS. 3A-3D illustrate the setting tool 52. The setting tool 52 may include the debris barrier 51, the packoff 56, a hanger actuator 58, a packer actuator 59, a mandrel 60, and a latch 61. The mandrel 60 may have a bore formed therethrough and include two or more tubular sections 60*a,u,b* connected together, such as by threaded couplings and/or fasteners. An adapter mandrel section 60*a* may have a threaded coupling, such as a box, formed at an upper end thereof for connection to a lower end of the drill pipe 9*p*. An upper portion of an upper mandrel section 60*u* may be connected to a lower end of the adapter section 60*a*, such as by threaded couplings and a keyed connection 62*a*. An upper portion of a lower mandrel section 60*b* may be connected to a lower portion of the upper mandrel section 60*u*, such as by threaded couplings and a keyed connection 62*b*. An upper end of the running tool 53 may be connected to a lower end of the lower mandrel section 60*b*, such as by threaded couplings and a keyed connection 62*c*.

Each keyed connection 62*a-c* may include an outer keyway formed through a wall of an outer member and a corresponding inner keyway formed in an outer surface of the inner member. Each outer member may have a flange formed in the wall thereof adjacent to the respective keyway for receiving a key 63. Each flange may have one or more (two shown) threaded sockets formed therein. Each key 63 may have a flange portion and a shank portion. The key flange portion may engage the respective flange of the outer member and have sockets corresponding to the threaded sockets thereof. A threaded fastener 64 may be inserted through each flange portion and screwed into the respective threaded socket of the outer member, thereby fastening the key 63 thereto. Each key shank portion may extend through the respective keyway of the outer member and into the respective keyway of the inner member, thereby longitudinally and torsionally connecting the outer and inner members. The outer member may also have a shoulder and seal surface formed adjacent to the flange for receiving a cover sleeve 65*c* and a cover seal 65*s*.

A seal receptacle may be formed in an inner surface of the adapter section 60*a* at a lower portion thereof and a top of the upper mandrel section 60*u* may carry a seal 68*a* on an outer surface thereof and be stabbed into the seal receptacle, thereby sealing an interface between the adapter section and the upper mandrel section. A seal receptacle may be formed in an inner surface of the lower mandrel section 60*b* at an upper portion thereof and a bottom of the upper mandrel section 60*u* may carry a seal 68*g* on an outer surface thereof and be stabbed into the seal receptacle, thereby sealing an interface between the upper and lower mandrel sections. A seal receptacle may be formed in an inner surface of the running tool 53 at an upper portion thereof and a bottom of the lower mandrel section 60*b* may carry a seal 68*i* on an outer surface thereof and be stabbed into the seal receptacle, thereby sealing an interface between the setting tool 52 and the running tool.

The hanger actuator 58 may include a piston 58*p*, one or more sleeves 58*u,m,b*, and a cylinder 67. The actuator sleeves 58*u,m,b* and piston 58*p* may interconnected, such as by threaded couplings and/or fasteners. The actuator sleeves 58*u,m,b* and piston 58*p* may be disposed around and extend along an outer surface of the upper mandrel section 60*u*. An upper actuator sleeve 58*u* may carry a pin 69*p* extending into a slot 69*s* formed in an outer surface of and along the upper mandrel section 60*u*. The pin and slot 69*p,s* connection may link the sleeves 58*u,m,b* and piston 58*p* to the mandrel 60 to allow relative longitudinal movement therebetween while retaining a torsional connection. The upper actuation sleeve may have a threaded test socket 66*a* formed through a wall thereof for pressure testing of the various seals of the setting tool 52. A lower actuator sleeve 58*b* may have equalization ports 66*b,c* formed through walls thereof and spaced therealong.

A bottom of the cylinder 67 may be connected to a top of the lower mandrel section 60*b*, such as by threaded couplings and/or fasteners. The top of the lower mandrel section 60*b* may carry an inner seal 68*f* for sealing against an outer surface of the upper mandrel section 60*u* and an outer seal 68*e* for sealing against an inner surface of the cylinder 67. An actuation chamber 70 may be formed radially between the upper mandrel section 60*u* the cylinder 67 and longitudinally between a shoulder formed in an inner surface of the cylinder and a top of the lower mandrel section 60*b*. A foot of the piston 58*p* may be disposed in the actuation chamber 70 and may divide the chamber into an upper portion and a lower portion.

The actuation chamber upper portion may be in fluid communication with the mandrel bore via an actuation port 66*d* formed through a wall of the upper mandrel section 60*u*, an inner port 66*f* formed through a heel of the piston 58*p*, and an outer port 66*e* formed through a toe of the piston. The piston foot may carry inner 68*d* and outer 68*c* seals for sealing respective sliding interfaces between the piston foot and the mandrel upper section 60*a* and between the piston foot and the cylinder 67. The cylinder 67 may carry a seal 68*b* in an inner surface thereof for sealing a sliding interface between a leg of the piston 58*p* and the cylinder. The piston leg may carry a seal 68*j* in an inner surface thereof for sealing a sliding interface between the piston leg and the mandrel upper section 60*u*.

The piston 58*p* and sleeves 58*u,m,b* may be longitudinally movable relative to the cylinder 67 between an upper position (shown) and a lower position (FIG. 5C) in response to a pressure differential between an upper face of the foot and a lower face of the foot. The chamber lower portion may be in fluid communication with a surge chamber 57*a* (FIGS. 2B-2D) via a bypass passage 66*p* and a bypass port 53*p* of the running tool 53. The surge chamber 57*a* may formed radially between a lower portion of the LDA 9*d* (below the packoff 56) and the liner string 15 and longitudinally between the packoff 56 and a top wiper plug 55*u* of the plug release system 55. The bypass passage 66*p* may be formed in a wall of the lower mandrel section 60*b* and extend from a top thereof to a location adjacent to and above the seal 68*i*, thereby bypassing the packoff 56. An outer surface of the lower mandrel section 60*b* may carry a seal 68*h* adjacent to and above a lower end of the bypass passage 66*p*. The seal 68*h* may engage the seal receptacle of the running tool to seal an interface between the bypass passage 66*p* and the running tool bypass port 53*p*.

Figure 4A:
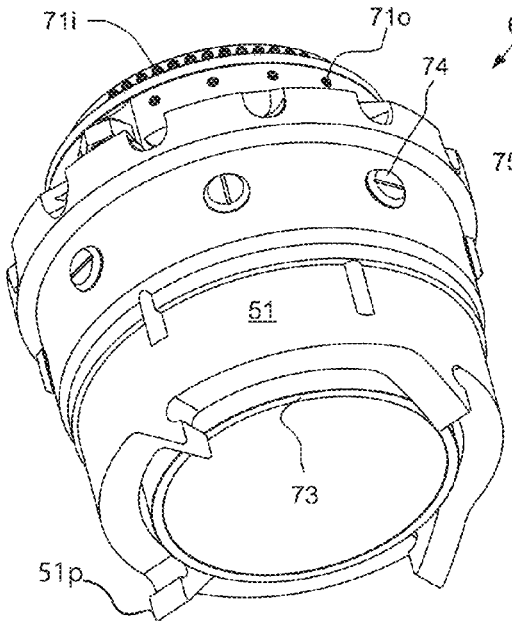
FIGS. 4A and 4B a latch of the setting tool.
Figure 4B:
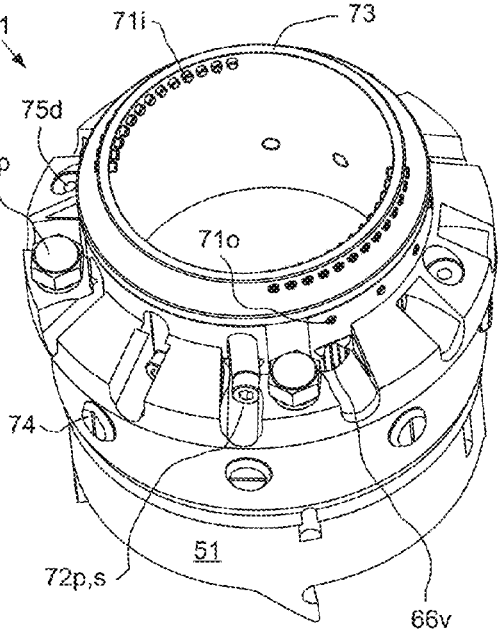
Figure 4C:
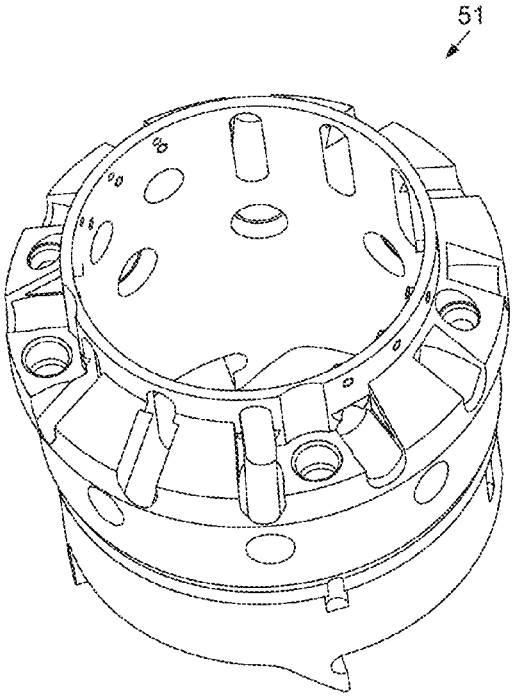
FIG. 4C illustrates a debris barrier of the setting tool.
Figure 4D:
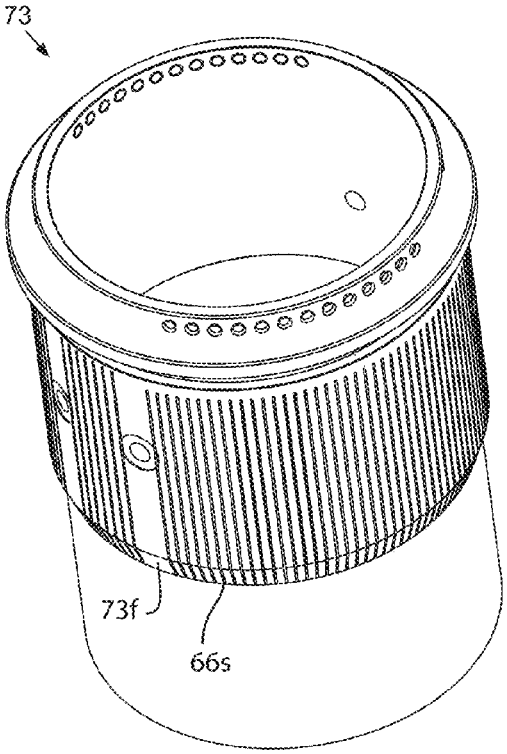
FIG. 4D illustrates a lock sleeve of the latch.

FIGS. 4A and 4B illustrate the latch 61. FIG. 4C illustrates the debris barrier 51. FIG. 4D illustrates a lock sleeve 73 of the latch 61. The latch 61 may releasably connect the piston 58*p* to the debris barrier 51 and the debris barrier to the PBR 15*r*. The latch 61 may include one or more inner shearable fasteners 71*i*, one or more outer shearable fasteners 71*o*, one or more pin 72*p* and slot 72*s* connections, the lock sleeve 73, and one or more fasteners, such as dogs 74. The lock sleeve 73 may have one or more threaded sockets formed through a wall thereof at a top thereof. The upper actuator sleeve 58*u* may have sockets formed in an outer surface thereof corresponding to the lock sleeve sockets. The inner shearable fasteners 71*i* may each be screwed into the respective threaded sockets of the lock sleeve 73 and extend into the socket of the upper actuator sleeve 58*u*, thereby fastening the piston 58*p* and the lock sleeve (longitudinal and torsional connection). The inner shearable fasteners 71*i* may be configured to fracture at a threshold force corresponding to a setting force of the liner hanger 15*h*, such as slightly greater than the hanger setting force. The threshold force may also be substantially less than a setting force of the packer 15*p*. The setting force of the packer 15*p* may be substantially greater than the setting force of the liner hanger, such as greater than or equal to twice, four times, or eight times the hanger setting force.

The debris barrier 51 may have one or more threaded sockets formed through a wall thereof at a top thereof. The lock sleeve 73 may have a groove formed in an outer surface thereof corresponding to the lock sleeve sockets. One of the outer shearable fasteners 71*o* may be screwed into the respective threaded socket of the debris barrier 51 and extend into the groove of the lock sleeve 73, thereby fastening the debris barrier and the lock sleeve. The outer shearable fasteners 71*o* may be configured to fracture at a threshold force. The lock sleeve 73 may have a load shoulder 73*s* formed in an outer surface thereof for receiving the top of the debris barrier 51. The lock sleeve 73 may carry the pin 72*p* extending into a slot 72*s* formed through a wall of the debris barrier 51. The pin and slot 72*p,s* connection may link the debris barrier 51 to the lock sleeve 73 to allow relative longitudinal movement therebetween for release of the dogs 74 while retaining a torsional connection. The outer shearable fasteners 71*o* may restrain the lock sleeve 73 in a lower engaged position relative to the debris barrier 51. Once the outer shearable fasteners 71*o* have fractured, the lock sleeve 73 may be free to move longitudinally upward relative to the debris barrier 51 to a disengaged position.

Figures 5A, 5B, 5C, 5D, 5E:
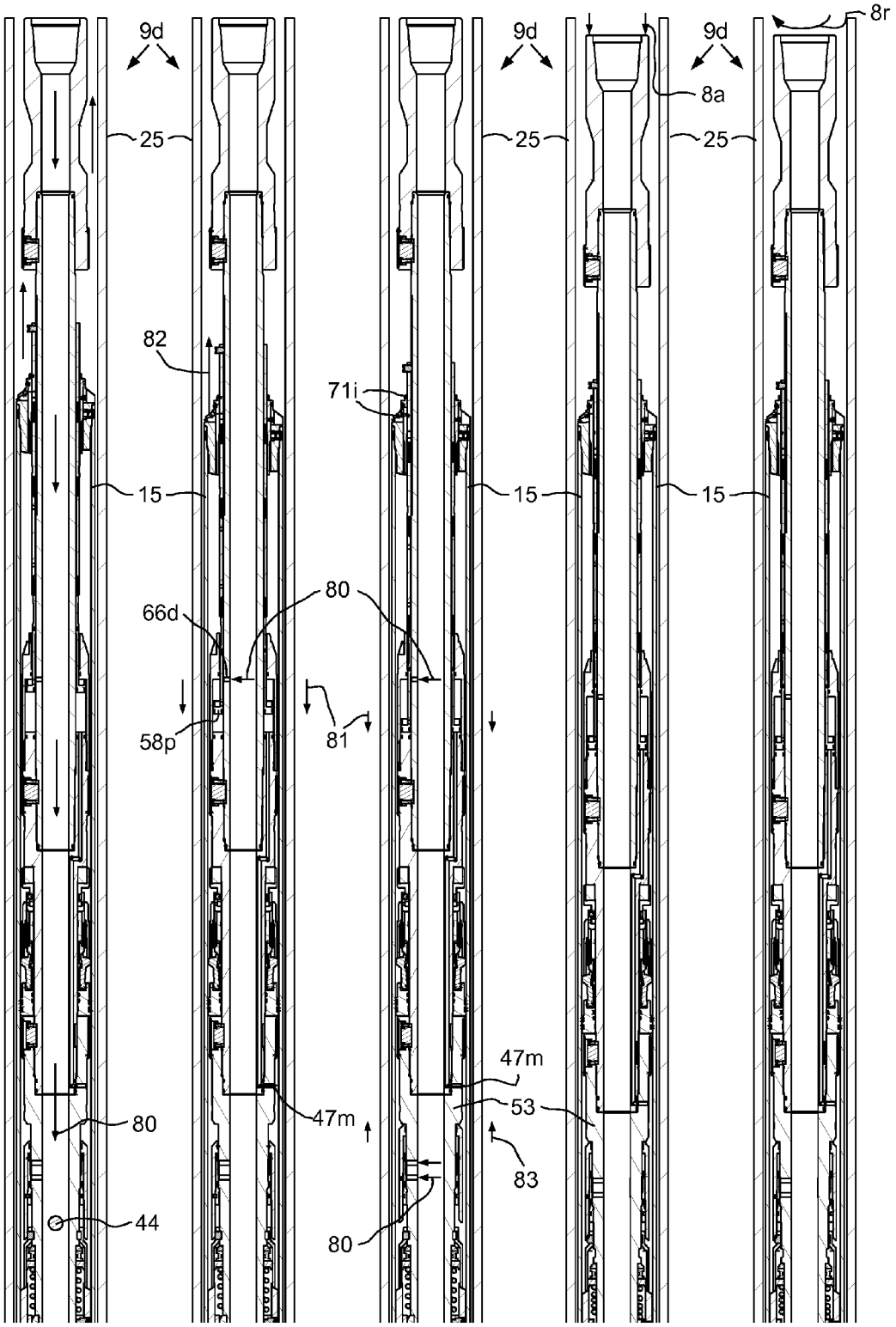
FIGS. 5A-5J illustrate operation of an upper portion of the LDA.
Figures 5F, 5G, 5H, 5I, 5J:
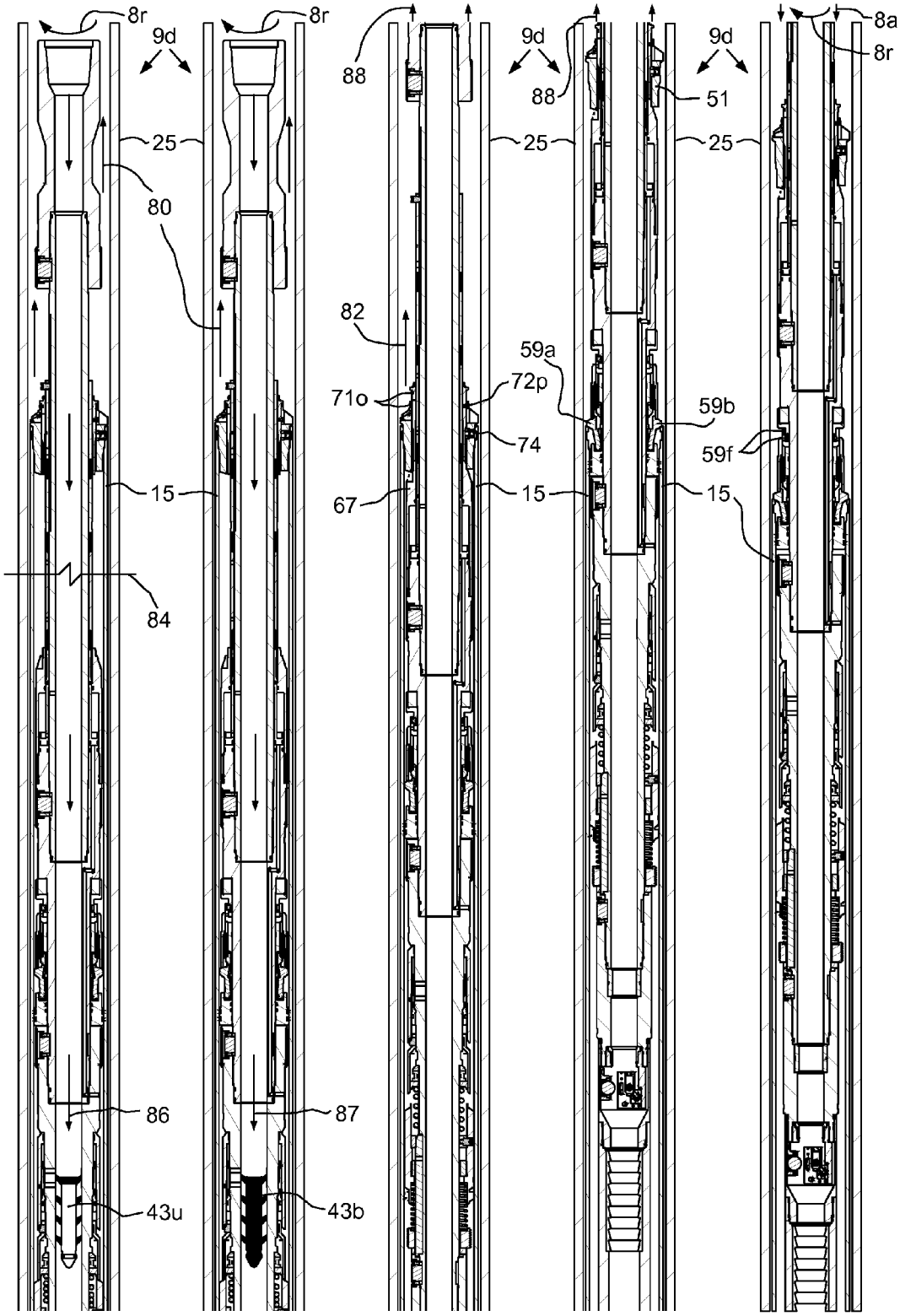

The debris barrier 51 may have one or more openings formed therethrough and spaced therearound for receiving a respective dog 74 therein. Each dog 74 may extend into a groove formed in the inner surface of the PBR 15*r*, thereby fastening the debris barrier 51 to the PBR. Each dog 74 may be radially movable relative to the debris barrier 51 between an extended position (shown) and a retracted position (FIG. 5H). Each dog 74 may be extended by interaction with a cam profile 73*f* formed in an outer surface of the lock sleeve 73. The lock sleeve cam profile 73*f* may be moved into the disengaged position by engagement of a top of the cylinder 67 with a bottom of the lock sleeve 73. Each dog 74 may further have an inner lip and an outer lug. The lip may trap the dogs 74 between a stop profile formed in the debris barrier opening and the lock sleeve outer surface. Each lug may be chamfered to interact with chamfers of the PBR groove to radially push the dogs 74 to the retracted position in response to longitudinal movement of the debris barrier 51 relative to the PBR 15*r*.

To ensure release of the PBR should the latch 61 jam, each dog 74 may include an inner ring 74*i* (FIG. 3B) having a threaded bore and an outer shearable fastener 74*o*. To assemble the dog 74, the shearable fastener 74*o* may be screwed into the ring bore. The shearable fastener 74*o* may then engage the PBR groove and may be fractured by pulling the workstring 9 until a threshold fracture force of the dogs 74 is reached.

Figure 3A:
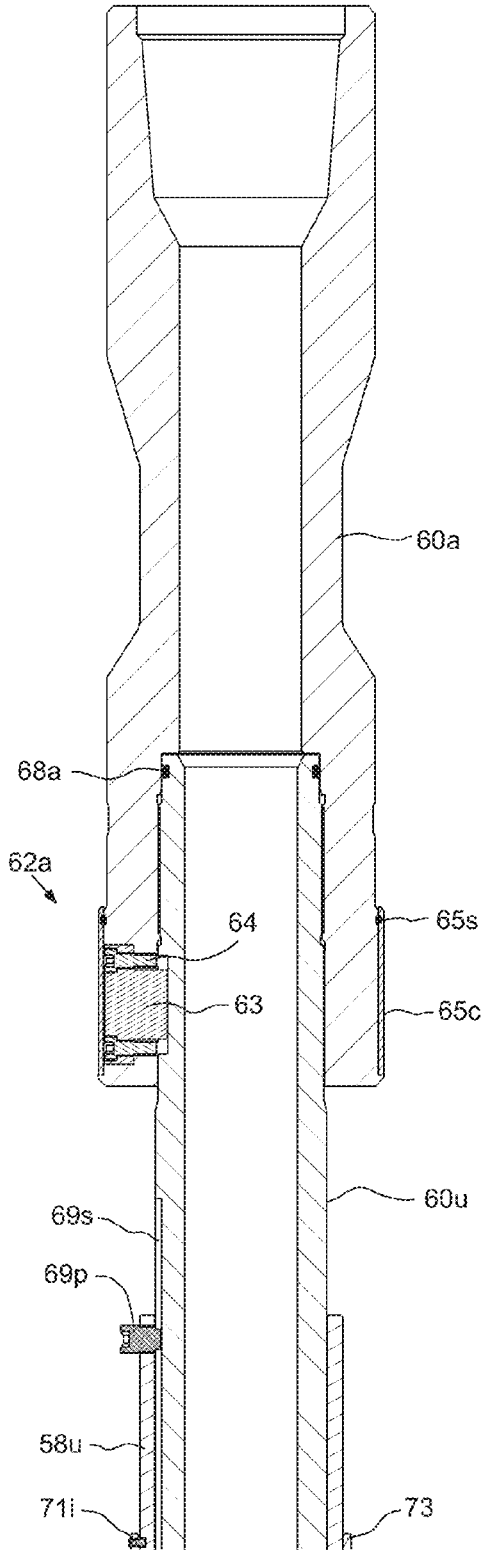
FIGS. 3A-3D illustrate a setting tool of the LDA.
Figure 3B:
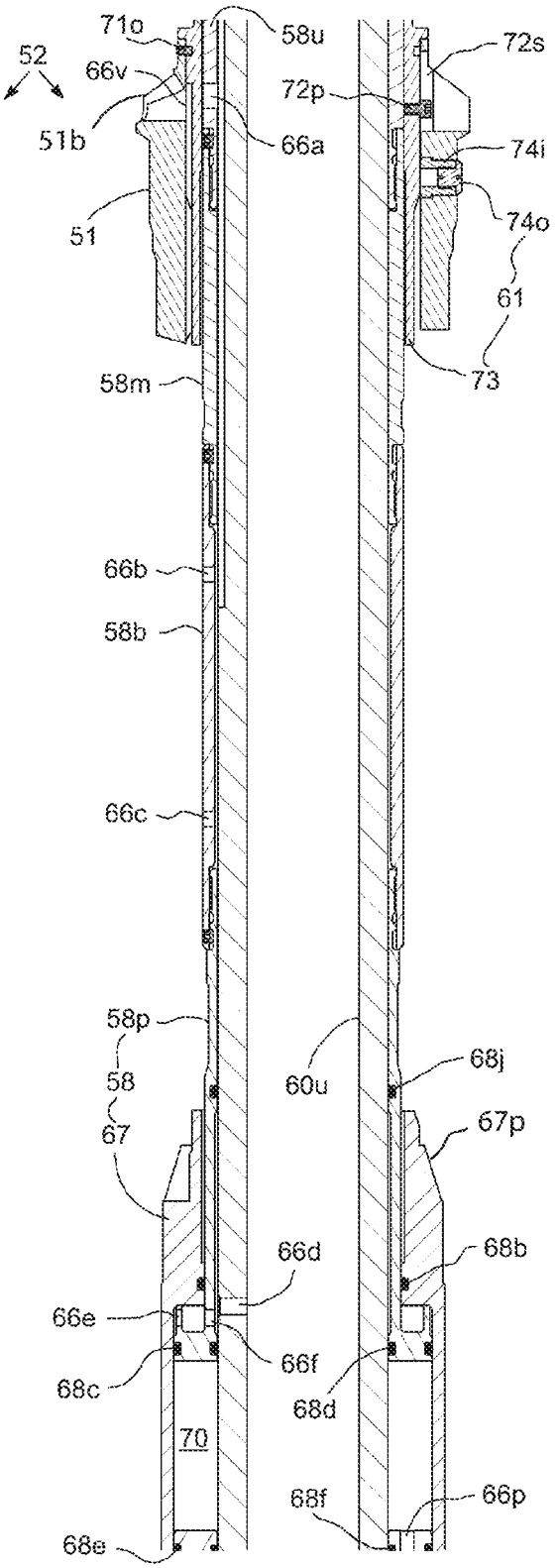
Figure 3C:
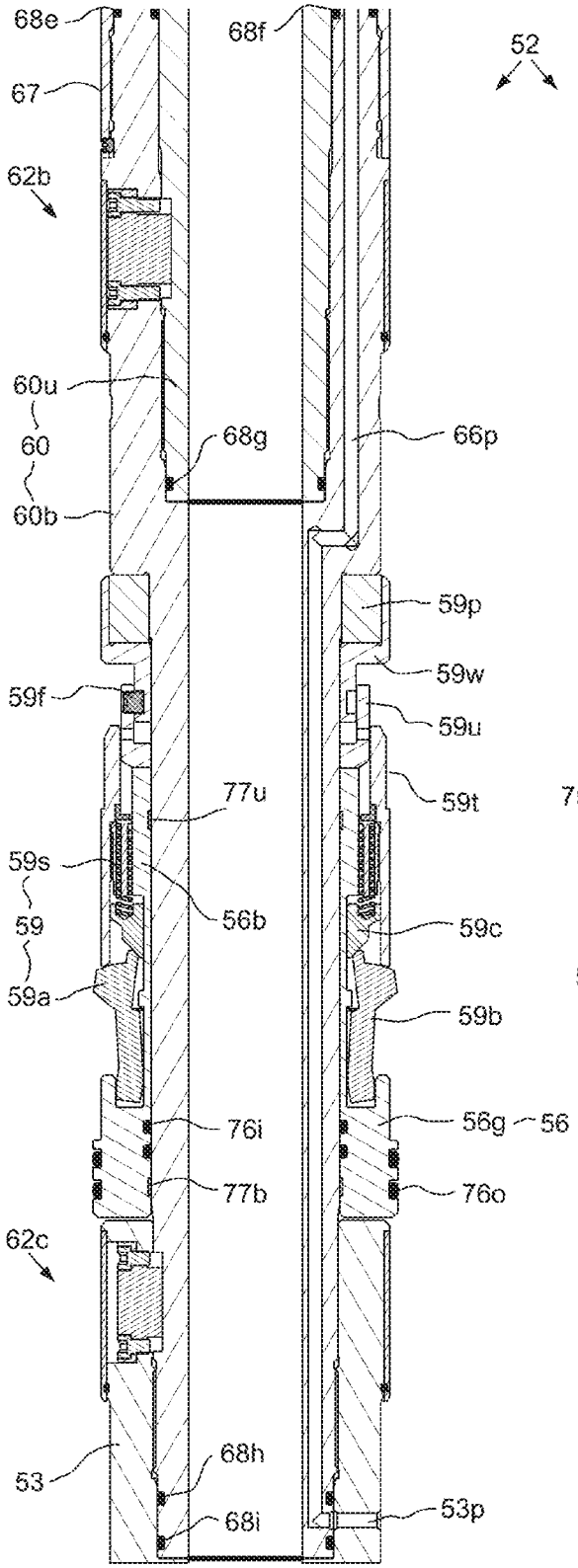
Figure 3D:
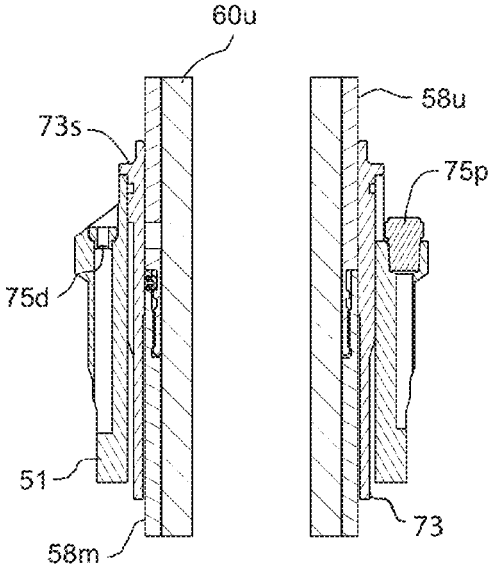

The debris barrier 51 may further have a load shoulder formed in an outer surface thereof for receiving a top of the PBR 15*r*. The debris barrier 51 may further have a fill passage formed therethrough and closed by a plug 75*p* (FIG. 3D). The debris barrier 51 may further have a relief passage formed therethrough and closed by a rupture disk 75*d*. The debris barrier 51 may have a torsion profile formed in a lower end thereof and the cylinder 67 may have a complementary torsion profile 67*p* formed in an upper end thereof. The debris barrier 51 may further have reamer blades 51*b* formed in an upper face thereof. The torsion profiles 51*p* 67*p* may mate during removal of the LDA 9*d* from the liner string 15, thereby torsionally connecting the debris barrier 51 to the mandrel 60. The debris barrier 51 may then be rotated during removal to back ream debris accumulated adjacent an upper end of the PBR 15*r*.

To accommodate displacement of the buffer fluid 82 during actuation of the LDA 9*d*, a vent passage 66*v* may be formed in an interface between the lock sleeve 73 and the debris barrier 51. The vent passage 66*v* may include filter slots 66*s* formed in and around the cam profile 73*f* of the lock sleeve 73 and spaces formed between the reamer blades 51*b* of the debris barrier 51. The vent passage 66*v* may provide limited fluid communication between the buffer chamber 57*b* and the annulus 48 while preventing contamination of the buffer chamber 57*b*.

Returning to FIG. 3C, the lower mandrel section 60*b* may have a recess formed in the outer surface for receiving the packer actuator 59. The packer actuator 59 may be longitudinally connected to the mandrel by entrapment between a load shoulder of the recess and a top of the running tool 53. The packer actuator 59 may include the packoff 56, a plurality of fasteners, such as dogs 59*a,b*, a cam 59*c*, one or more retainers 59*u,t*, a thrust bearing 59*p,w*, and one or more radial bearings 77*u,b*.

The packoff 56 may include an upper body portion 56*b*, a lower gland portion 56*g*, one or more (two shown) inner seals 76*i*, and one or more (two shown) outer seals 76*o*. The gland portion 56*g* may have a groove formed in an outer surface thereof for receiving each outer seal 76*o*. Each outer seal 76*o* may engage an inner surface of the PBR 15*r*. Each outer seal 76*o* may include a seal ring, such as an S-ring, and a pair of anti-extrusion elements, such as garter springs. Each inner seal 76*i* may be an o-ring carried in a groove formed in an inner surface of the gland 56*g* to isolate an interface formed between the gland and the lower mandrel section 60*b*. Alternatively, each outer seal 76*o* may be an o-ring.

Each packoff portion 56*b,g* may carry a respective radial bearing 77*u,b*, and, along with the thrust bearing 59*p,w*, may facilitate rotation of the mandrel 60 relative to the packer actuator 59, thereby reducing stick slip of the drill string and affording better weight transfer to the packer 15*p*. The thrust bearing 59*p,w* may include a thrust pad 59*p* for engagement with the load shoulder of the lower mandrel section 60*b* and carried in an enlarged upper portion of a thrust washer 59*w*. An upper retainer 59*u* may be connected to a lower end of the thrust washer 59*w*, such as by a shearable fastener 59*f*. The shearable fastener 59*f* may fracture when a threshold force is exerted on the thrust washer 59*w*. The threshold force may correspond to a setting force of the packer 15*p* to provide confirmation that adequate setting force was exerted on the packer 15*p* to properly set the packer. The body portion 56*b* may have a threaded coupling formed in an outer surface thereof and the lower retainer 59*t* may have a complementary threaded coupling formed in an inner surface thereof and engaged therewith, thereby connecting the lower retainer to the body portion. A lower end of the upper retainer 59*u* may be received in a bore of the lower retainer and may engage a top of the body portion 56*b*.

Figures 2A, 2B, 2C, 2D:
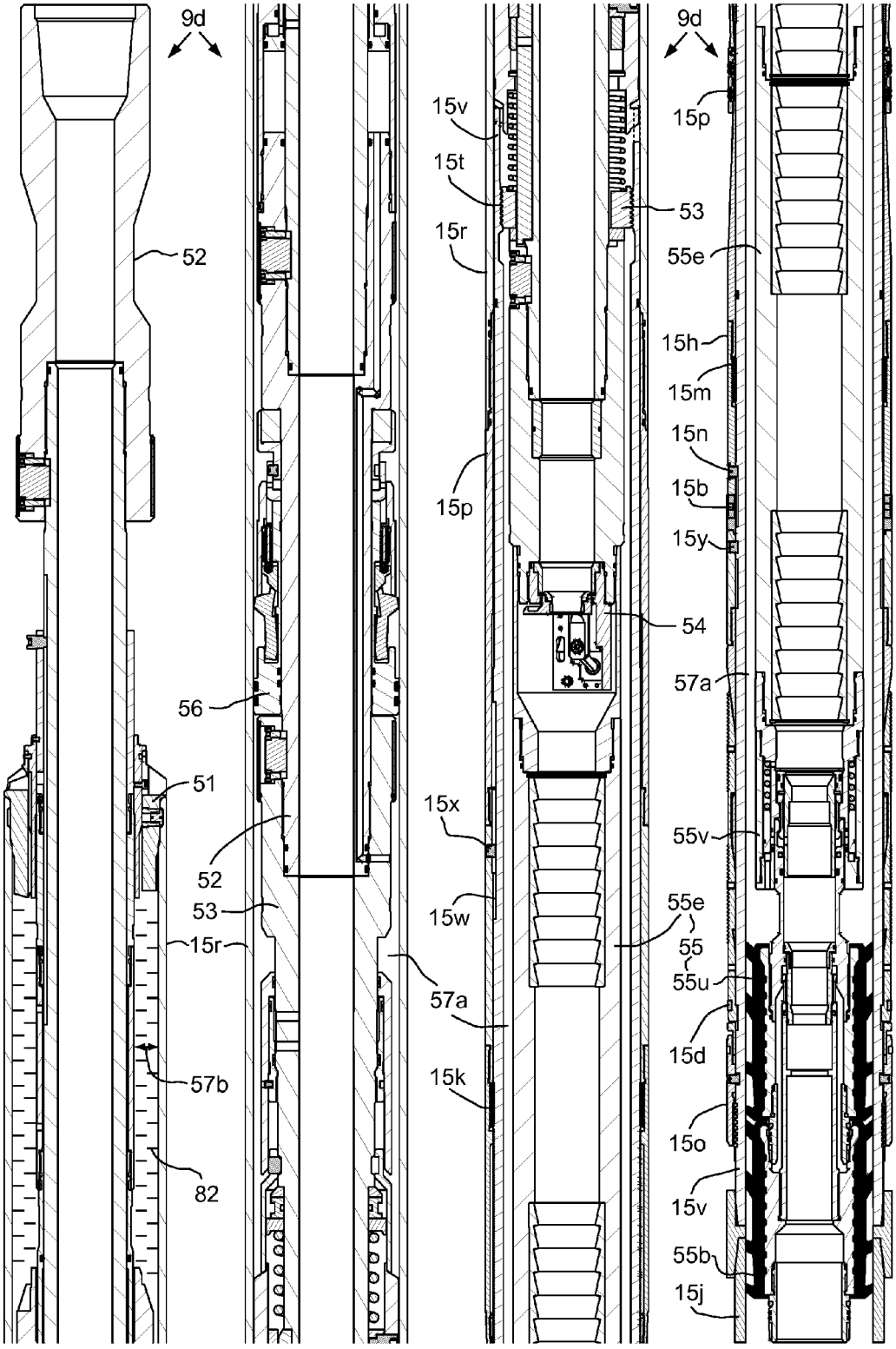
FIGS. 2A-2D illustrate a liner deployment assembly (LDA) of the drilling system.

A pocket may be formed between the body portion 56*b* and the lower retainer 59*t*. The dogs 59*a,b* may be disposed in the pocket and spaced around the pocket. Each dog 59*a,b* may be movable relative to the body portion 56*b* and lower retainer 59*t* between a retracted position (shown) and an extended position (FIG. 5I). The cam 59*c* may be disposed in the pocket and longitudinally movable relative to the body portion 56*b* and lower retainer 59*t* between an upper position (shown) and a lower position (FIG. 5I). The cam 59*c* may be urged toward the lower position by a biasing member, such as one or more (two shown) compression springs 59*s*. An upper portion of each dog 59*a,b* may have an outer lug for engagement with a top of the PBR 15*r* and an inner cam surface engaged with the cam 59*c*. A lower portion of each dog 59*a,b* may be received in a groove formed in the packoff 56 at an interface between the gland portion 56*g* and the body portion 56*b*. The dogs 59*a,b* may be held in the retracted position by insertion of the packer actuator 59 into the PBR 15*r* (FIG. 2B).

Returning to FIGS. 2B-2D, the running tool 53 may include a body, a lock, a clutch, and a latch. The body may have a bore formed therethrough and include two or more tubular sections. An inner body section may be connected to a lower body section, such as by threaded couplings. A spacer may be disposed between a lower end of the inner body section and a shoulder formed in an inner surface of the lower body section. A fastener, such as a threaded nut, may be connected to a threaded coupling formed in an outer surface of the inner body section and may receive an upper end of the outer housing section. The body may also have a threaded coupling formed at a lower longitudinal end thereof for connection to the catcher 54.

The running tool latch may longitudinally and torsionally connect the HP body 15*v* to an upper portion of the LDA 9*d*. The latch may include a thrust cap, a longitudinal fastener, such as a floating nut, and a biasing member, such as a lower compression spring. The thrust cap may have an upper shoulder formed in an outer surface thereof and adjacent to an upper end thereof, an enlarged mid portion, a lower shoulder formed in an outer surface thereof, a torsional fastener, such as a key, formed in an outer surface thereof, a lead screw formed in an inner surface thereof, and a spring shoulder formed in an inner surface thereof. The key may mate with a torsional profile, such as a castellation, formed in an upper end of the HP body 15*v* and the floating nut may be screwed into a thread 15*t* of the HP body. The lock may be disposed on the inner body section to prevent premature release of the latch from the PBR 15*r*. The clutch may selectively torsionally connect the thrust cap to the running tool body.

The running tool lock may include one or more (two shown) actuation ports formed through a wall of the inner body section, a piston, a plug, a fastener, such as a dog, and a sleeve. The plug may be connected to an outer surface of the inner body section, such as by threaded couplings. The plug may carry an inner seal and an outer seal. The inner seal may isolate an interface formed between the plug and the body and the outer seal may isolate an interface formed between the plug and the piston. The piston may be longitudinally movable relative to the body between an upper position (FIG. 5C) and a lower position (shown). The piston may initially be fastened to the plug, such as by a shearable fastener. In the lower position, the piston may have an upper portion disposed around the inner body section, a mid portion disposed along an outer surface of the plug, and a lower portion received by the lock sleeve, thereby locking the dog in a retracted position. The piston may carry an inner seal in the upper portion for isolating an interface formed between the body and the piston. An actuation chamber may be formed between the piston, plug, and the inner body section and be in fluid communication with the actuation ports.

The running tool lock sleeve may have an upper portion disposed along an outer surface of the inner body section and an enlarged lower portion. The lock sleeve may have an opening formed through a wall thereof to receive the dog therein. The dog may be radially movable between the retracted position (FIG. 2B) and an extended position (FIG. 5D). In the retracted position, the dog may extend into a groove formed in an outer surface of the inner body section, thereby fastening the lock sleeve to the body. The groove may have a tapered upper end for pushing the dog to the extended position in response to relative longitudinal movement therebetween.

The running tool clutch may include a biasing member, such as upper compression spring, a thrust bearing, a gear, a lead nut, and a torsional coupling, such as key. The thrust bearing may be disposed in the lock sleeve lower portion and against a shoulder formed in an outer surface of the inner body section. A spring washer may be disposed adjacent to a bottom of the thrust bearing and may receive an upper end of the clutch spring, thereby biasing the thrust bearing against the running tool body shoulder. The inner body section may have a torsional profile, such a keyway formed in an outer surface thereof adjacent to a lower end thereof. The key may be disposed the keyway. The key may be kept in the keyway by entrapment between a shoulder formed in an outer surface of the lower body section and a shoulder formed in an upper end of the lower body section.

The running tool gear may be connected to the thrust cap, such as by a threaded fastener, and have teeth formed in an inner surface thereof. Subject to the lock, the gear and thrust cap may be movable between an upper position (FIG. 6E) and a lower position (shown). In the lower position, the gear teeth may mesh with the key, thereby torsionally connecting the thrust cap to the body. The lead nut may be engaged with the lead screw and have a keyway formed in an inner surface thereof and engaged with the key, thereby longitudinally connecting the lead nut and the thrust cap while providing torsional freedom therebetween and torsionally connecting the lead nut and the body while providing longitudinal freedom therebetween. A lower end of the clutch spring may bear against an upper end of the gear. The thrust cap and gear may initially be trapped between a lower end of the lock sleeve and a shoulder formed in an outer surface of the key.

The running tool spring shoulder of the thrust cap may receive an upper end of the latch spring. A lower end of the latch spring may be received by a shoulder formed in an upper end of the float nut. A thrust ring may be disposed between the float nut and an upper end of the lower body section. The float nut may be urged against the thrust ring by the latch spring. The float nut may have a thread formed in an outer surface thereof. The thread may be opposite-handed, such as left handed, relative to the rest of the threads of the workstring 9. The float nut may be torsionally connected to the body by having a keyway formed along an inner surface thereof and receiving the key, thereby providing upward freedom of the float nut relative to the body while maintaining torsional connection thereto. Threads of the lead nut and lead screw may have a finer pitch, opposite hand, and greater number than threads of the float nut and packer dogs to facilitate lesser (and opposite) longitudinal displacement per rotation of the lead nut relative to the float nut.

The catcher 54 may be a mechanical ball seat including a body and a seat fastened to the body, such as by one or more shearable fasteners. The seat may also be linked to the body by a cam and follower. Once the ball 44 is caught, the seat may be released from the body by a threshold pressure exerted on the ball. The threshold pressure may be greater than a pressure required to set the liner hanger 15*h* and greater than a pressure required to unlock the running tool 53. Once released, the seat and ball 44 may swing relative to the body into a capture chamber, thereby reopening the LDA bore. The threshold pressure may also be greater than the pressure necessary to fracture the inner shearable fasteners 71*i*.

The plug release system 55 may include a launcher 55*e*, a relief valve 55*v* and one or more cementing plugs, such as the top wiper plug 55*u* and a bottom wiper plug 55*b*. Each of the launcher 55*e* and wiper plugs 55*u,b* may be a tubular member having a bore formed therethrough. The launcher 55*e* may include a housing and an upper latch and the top wiper plug may include a lower latch. The housing may include two or more tubular sections connected to each other, such as by threaded couplings. The housing may have a coupling, such as a threaded coupling, formed at an upper end thereof for connection to the seat 54. The launcher 55*e* may have a sufficient length such that the workstring 9 may be raised to confirm release of the running tool 53 while the wiper plugs 55*u,b* remain in the HP body 15*v*.

The relief valve 55*v* may include a body, a piston, and a biasing member, such as a compression spring. The body may include a sleeve connected to the launcher housing and a cap connected to the sleeve, such as by threaded couplings. The piston and spring may be disposed in a chamber formed between the launcher housing and the valve body. The valve cap may have an inlet port formed therethrough providing fluid communication between the surge chamber 57*a* and a bottom face of the piston. An outlet port may be formed by a gap between a top of the cap and a lower end of the launcher housing for providing fluid communication between the chamber and a bore of the launcher 55*e* and an equalization port may be formed through a wall of the launcher housing for providing fluid communication between an upper face of the piston and the launcher bore.

The relief valve piston may be longitudinally movable in the chamber and relative to the valve body between an upper open position (FIG. 6B) and a lower closed position (FIG. 2D). The spring may be disposed between an upper face of the piston and an upper end of the chamber, thereby biasing the piston toward the lower closed position. The piston may move to the upper open position in response to pressure in the surge chamber 57*a* being greater than pressure in the launcher bore by a pressure differential sufficient to overcome a biasing force of the spring. The spring may be configured such that the pressure differential may be in the range of thirty to one hundred psi. The launcher housing and cap may each carry a seal straddling the outlet port and the piston may be aligned with the outlet port and engaged with the seals in the lower closed position, thereby isolating the outlet port from the inlet port. The piston may be clear of the outlet port in the upper open position, thereby allowing fluid communication between the inlet and outlet ports. Alternatively, the spring may have a nominal stiffness or be omitted and the valve may function as a check valve instead of a relief valve.

Each wiper plug 55*u,b* may include a body and a wiper seal. Each body may have a latch profile for engagement with a respective latch, thereby fastening the respective plug 55*u,b* to the respective top plug 55*u* or launcher 55*e*. Each plug body may further have a landing profile formed in an inner surface thereof. Each landing profile may have a landing shoulder, an inner latch profile, and a seal bore for receiving the respective dart 43*u,b*. Each dart 43*u,b* may have a complementary landing shoulder, landing seal, and a fastener for engaging the respective inner latch profile, thereby connecting the dart and the respective wiper plug 55*u,b*. The bottom dart 43*b* may have a hollow body closed by a diaphragm for rupture after seating of the bottom dart and plug 55*b* onto the float collar 15*c*. Each plug body may be made from a drillable material, such as cast iron, non-ferrous metal or alloy, fiber reinforced composite, or engineering polymer, and each wiper seal may be made from an elastomer or elastomeric copolymer.

Figures 6A, 6B, 6C, 6D, 6E:
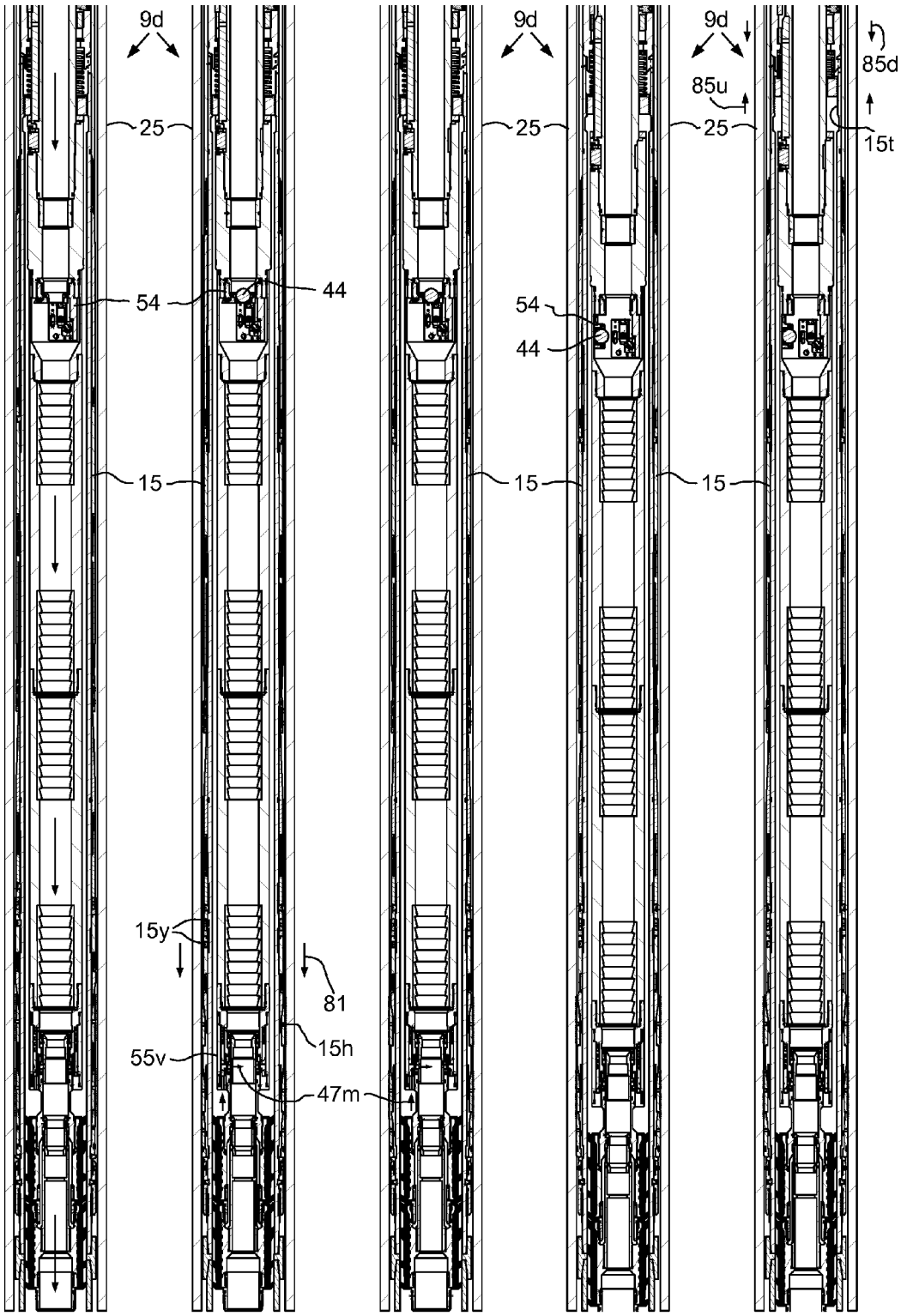
FIGS. 6A-6J illustrate operation of a lower portion of the LDA.

FIGS. 5A-5J illustrate operation of an upper portion of the LDA 9*d*. FIGS. 6A-6J illustrate operation of a lower portion of the LDA 9*d*. Referring specifically to FIGS. 5A and 6A, as the liner string 15 is being advanced 8*a* into the wellbore 24 by the workstring 9, resultant surge pressure of the drilling fluid 47*m* may be communicated to the surge chamber 57*a* via leakage through the directional seals of the wiper plugs 55*u,b*. The surge pressure may then be communicated to the lower face of the actuator piston 58*p* via the running tool bypass port 53*p* and the bypass passage 66*p*. The surge pressure may also be communicated to an upper face of the running tool piston exposed to the surge chamber 57*a*. This communication of the surge pressure to the lower face of the actuator piston 58*p* and the upper face of the running tool piston may negate tendency of the surge pressure communicated to an upper face of the actuator piston 58*p* by the actuation port 66*d* and to the lower face of the running tool piston by the running tool actuator ports from prematurely setting the liner hanger 15*h* and prematurely unlocking the running tool 53. Once the liner string 15 has been advanced 8*a* into the wellbore 24 by the workstring 9 to a desired deployment depth and the cementing head 7 has been installed, conditioner 80 may be circulated by the cement pump 13 through the valve 41 to prepare for pumping of cement slurry 86. The ball launcher 7*s* may then be operated and the conditioner 80 may propel the ball 44 down the workstring 9 to the catcher 54. The ball 44 may land in the seat of the catcher 54.

Referring specifically to FIGS. 5B and 6B, once the ball 44 has landed continued pumping of the conditioner 80 may increase pressure on the seated ball, thereby also pressurizing the actuation chamber 70 and exerting pressure on the actuator piston 58*p*. The actuator piston 58*p* may in turn exert a setting force on the PBR 15*r* via the actuator sleeves 58*u,m,b*, the lock sleeve 73, and the debris barrier 51. The PBR 15*r* may in turn exert the setting force on the liner hanger upper portion via the packer 15*p*. The liner hanger upper portion may initially be restrained from setting the liner hanger 15*h* by the shearable fastener 15*y*. Once a first threshold pressure on the actuator piston 58*p* has been reached, the shearable fastener 15*y* may fracture, thereby releasing the liner hanger upper portion. The actuator piston 58*p*, actuator sleeves 58*u,m,b*, lock sleeve 73, the debris barrier 51, PBR 15*r*, packer 15*p*, and liner hanger upper portion may travel downward 81 until slips of the liner hanger 15*h* are set against the casing 25, thereby halting the movement. As the downward movement 81 is occurring, buffer fluid 82 displaced from the buffer chamber 57*b* may be discharged into the annulus 48 via the vent passage 66*v* and drilling fluid 47*m* displaced from the actuation chamber 70 may be discharged from the actuation chamber lower portion into the surge chamber 57*a* via the bypass passage 66*p* and running tool bypass port 53*p*. The relief valve 55*v* may open to discharge the displaced drilling fluid from the surge chamber 57*a* and into the launcher bore.

Referring specifically to FIGS. 5C and 6C, continued pumping of the conditioner 80 may further pressurize the actuation chamber 70 until a second threshold pressure is reached, thereby fracturing the inner shearable fasteners 71*i* and releasing the lock sleeve 73 and debris barrier 51 from the actuator piston 58*p*. The liner hanger 15*h* may be restrained from unsetting by the lower ratchet connection 15*m*. Downward movement 81 of the actuator piston 58*p* and actuator sleeves 58*u,m,b* may continue until the actuator piston reaches a lower end of the actuation chamber 70. Continued pumping of the conditioner 80 may further pressurize the LDA bore (above the seated ball 44). The running tool actuation chamber may be pressurized and exert pressure on the running tool piston. Once a third threshold pressure on the running tool piston has been reached, the shearable fastener may fracture, thereby releasing the piston. The running tool piston may travel upward 83 until an upper end thereof engages a shoulder formed in an outer surface of the inner body section, thereby halting the movement.

Referring specifically to FIGS. 5D and 6D, setting of the liner hanger 15*h* may be confirmed (not shown), such as by slacking the drill pipe 9*p* using the drawworks 12. Continued pumping of the conditioner 80 may further pressurize the LDA bore until a fourth threshold pressure is reached, thereby releasing the catcher seat from the catcher body. The catcher seat and ball 44 may swing relative to the catcher body into the capture chamber, thereby reopening the LDA bore. The drill pipe 9*p*, mandrel 60, and running tool body may then be lowered 8*a* while the lock sleeve 73 and debris barrier 51 remain stationary due release thereof from the actuator sleeve 58*u* by the fractured inner fasteners 71*i*. The running tool thrust cap and lock sleeve may be carried downward by the running tool body until the lower shoulder engages a landing shoulder formed by a top of the HP body 15*v*. Continued lowering 8*a* may cause the HP body shoulder to exert a reactionary force on the running tool thrust cap and lock sleeve, thereby pushing the running tool dog against the groove taper. The running tool dog may be pushed to the extended position, thereby releasing the thrust cap and lock sleeve. Lowering 8*a* may continue, thereby disengaging the running tool gear from the key. The lowering 8*a* may be halted by engagement of the running tool thrust cap upper end with a lower end of the spring washer.

Referring specifically to FIGS. 5E and 6E, the drill pipe 9*p*, mandrel 60, and running tool body may then be rotated 8*r* from surface by the top drive 5 to cause the running tool lead nut to travel down 85*d* the thrust cap lead screw while the float nut travels upward 85*u* relative to the thread 15*t* of the HP body 15*v*. The running tool float nut may disengage from the HP body thread 15*t* before the running tool lead nut bottoms out in the threaded passage. The rotation 8*r* may be halted by the running tool lead nut bottoming out against a lower end of the lead screw, thereby restoring torsional connection between the running tool thrust cap and the running tool body.

Figures 6F, 6G, 6H, 6I, 6J:
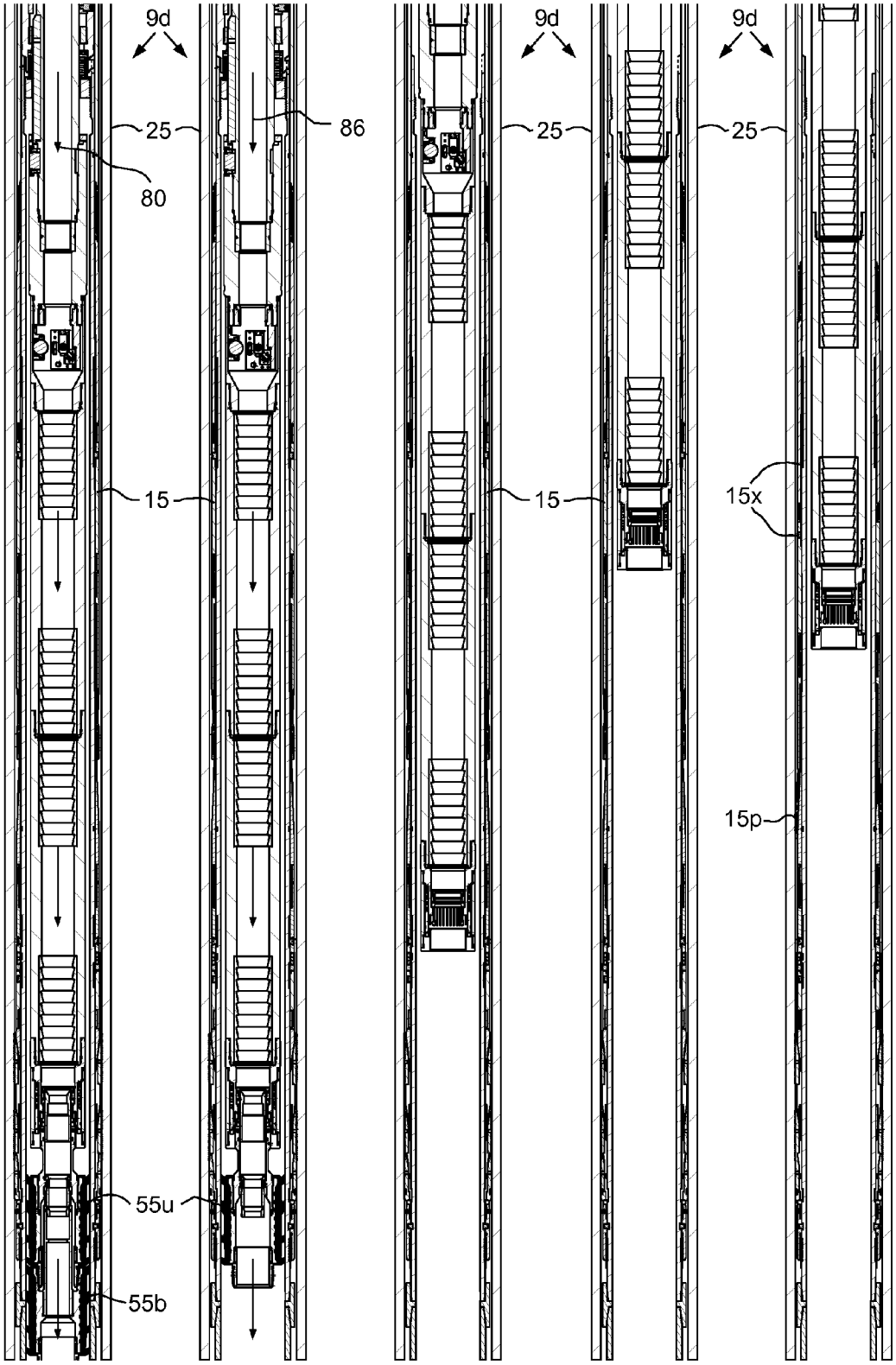

Referring specifically to FIGS. 5F and 6F, the workstring 9 (except for the lock sleeve 73 and debris barrier 51) may then be raised and then lowered (not shown) to confirm release of the running tool 53. The actuator sleeves 58*u,m,b*, mandrel upper section 60*u*, and PBR 15*r* may have sufficient length (depicted by break line 84) to accommodate the raising without engaging the cylinder 67 with the lock sleeve 73. The launcher 55*e* may have sufficient length to accommodate the raising such that the wiper plugs 55*u,b* remain in the HP body 15*v*. As the workstring 9 is being raised, the buffer fluid 82 may be displaced from the buffer chamber 57*b* and discharged into the annulus 48 via the vent passage 66*v*. As the workstring 9 is being lowered, conditioner 80 may be suctioned from the annulus 48 into the buffer chamber 57*b* via the vent passage 66*v* and filtered thereby to ensure that the buffer chamber 57*b* is not contaminated by particulates.

The workstring 9 and liner string 15 (except for the set hanger 15*h*) may then be rotated 8*r* from surface by the top drive 5 and rotation may continue during the cementing operation. Rotation of the rest of the liner string 15 relative to the set hanger 15*h* may be facilitated by the thrust bearing 15*b*. The bottom dart 43*b* may be released from the bottom launcher 7*b* by operating the bottom plug launcher actuator. Cement slurry 86 may be pumped from the mixer 42 into the cementing swivel 7*c* via the valve 41 by the cement pump 13. The cement slurry 86 may flow into the top launcher 7*u* and be diverted past the top dart 43*u* via the diverter and bypass passages. The cement slurry 86 may flow into the bottom launcher 7*b* and be forced behind the bottom dart 43*b* by closing of the bypass passages, thereby propelling the bottom dart into the workstring bore.

Referring specifically to FIGS. 5G and 6G, once the desired quantity of cement slurry 86 has been pumped, the top dart 43*u* may be released from the top launcher 7*u* by operating the top plug launcher actuator. Chaser fluid 87 may be pumped into the cementing swivel 7*c* via the valve 41 by the cement pump 13. The chaser fluid 87 may flow into the top launcher 7*u* and be forced behind the top dart 43*u* by closing of the bypass passages, thereby propelling the top dart into the workstring bore. Pumping of the chaser fluid 87 by the cement pump 13 may continue until residual cement in the cement line 14 has been purged. Pumping of the chaser fluid 87 may then be transferred to the mud pump 34 by closing the valve 41 and opening the valve 6. The train of darts 43*u,b* and slurry 86 may be driven through the workstring bore by the chaser fluid 87. The bottom dart 43*b* may reach the bottom wiper plug 55*b*, seat therein, and the bottom dart and plug may be released from the plug release system 55.

Referring specifically to FIGS. 5H and 6H, the top dart 43*u* may reach the top wiper plug 55*u*, seat therein, and the top dart and plug may be released from the plug release system 55. Continued pumping of the chaser fluid 87 may drive the train of darts 43*u,b*, wiper plugs 55*u,b*, and slurry 86 through the liner bore. The bottom dart and plug may land into the collar 15*c* and continued pumping of the chaser fluid 87 may rupture the diaphragm of the bottom dart, thereby allowing the slurry 86 to flow through the bottom dart and plug, the reamer shoe 15*s*, and into the annulus 48. Pumping of the chaser fluid 87 may continue until a desired quantity thereof has been pumped or the top dart 43*u* and top wiper plug 55*u* land onto the seated bottom dart 43*b* and wiper plug 55*b*.

Pumping of the chaser fluid 87 may be halted and rotation 8*r* of the workstring 9 may be halted. The workstring 9 (except for the lock sleeve 73 and debris barrier 51) raised 88 until the cylinder top engages the lock sleeve bottom. Continued raising 88 may exert the threshold force to fracture the outer shearable fasteners 71*o*, thereby releasing the lock sleeve 73 from the debris barrier 51. Continued raising 88 may move the lock sleeve cam profile 73*f* from engagement with the dogs 74 and engage the pin 72*p* with a top of the slot 72*s*. The debris barrier 51 may then be carried thereby with continued raising 88 and engagement of the dogs 74 with a top of the PBR latch profile may push the dogs inward to the retracted position, thereby releasing the debris barrier 51 from the PBR 15*r*. During the raising 88, the buffer fluid 82 may be displaced from the buffer chamber 57*b* and discharged into the annulus 48 via the vent passage 66*v*.

Referring specifically to FIGS. 5I and 6I, the raising 88 may continue and the cylinder and debris barrier torsional profiles may engage. The raising 88 may continue until the packer actuator 59 exits the PBR 15*r*, thereby allowing the dogs 59*a,b* to extend and engage the PBR top. Although not shown, the packoff 56 may be pulled out of the PBR bore.

Referring specifically to FIGS. 5J and 6J, rotation 8*r* of the workstring 9 may resume and the workstring 8*r* may be lowered 8*a*, thereby exerting weight on the PBR 15*r* via the engaged dogs 59*a,b*. The PBR 15*r* may in turn exert the weight on the packer upper portion. The shearable fastener 15*x* of the releasable connection 15*w,x* may engage the bottom of the slot 15*w* and fracture, thereby releasing the packer upper portion from the HP body 15*v*. The packing element may be driven along the wedge and expanded into engagement with the casing 25, thereby halting the movement. The shearable fastener 59*f* may then fracture, thereby indicating successful setting of the packer 15*p*. The packer 15*p* may be restrained from unsetting by the upper ratchet connection 15*k*. Once the packer 15*p* has been set, rotation 8*r* of the workstring 9 may be halted. Since the packoff 56 has been reengaged with the PBR bore, the packer 15*p* may be tested by pressurizing the annulus 48. The workstring 9 may then be raised (not shown) until the packoff 56 exits the PBR 15*r*. Rotation 8*r* may then be resumed, thereby rotating the debris barrier 51 via the engaged cylinder torsional profile and chaser fluid 87 circulated to ream and wash away any excess cement slurry 86. The workstring 9 may then be retrieved to the MODU 1*m*.

Alternatively, the setting tool 52 may be used to drive an expander through an expandable liner hanger. Alternatively, the setting tool 52 may be used to hang a casing string from a subsea wellhead. Alternatively, the liner string 15 may be hung from another liner string instead of the casing string 25.

Alternatively, the LDA 9*d* may further include a diverter valve (not shown) connected between the setting tool adapter section 60*a* and a lower end of the drill pipe 9*p* and drilling fluid not circulated during deployment of the liner string 15. The diverter valve 50 may include a housing, a bore valve, and a port valve. The bore valve may include a body and a valve member, such as a flapper, pivotally connected to the body and biased toward a closed position, such as by a torsion spring. The flapper may be oriented to allow downward fluid flow from the drill pipe 9*p* through the rest of the LDA 9*d* and prevent reverse upward flow from the LDA to the drill pipe 9*p*. Closure of the flapper may isolate an upper portion of a bore of the diverter valve from a lower portion thereof. The port valve may include a sleeve and a biasing member, such as a compression spring. The sleeve may include two or more sections connected to each other, such as by threaded couplings and/or fasteners. An upper section of the sleeve may be connected to a lower end of the bore valve body, such as by threaded couplings.

The diverter sleeve may be disposed in the housing and longitudinally movable relative thereto between an upper position and a lower position. The diverter housing may have one or more flow ports and one or more equalization ports formed through a wall thereof. The sleeve may have one or more equalization slots formed therethrough providing fluid communication between a spring chamber formed in an inner surface of the housing and a lower bore portion of the diverter valve. The sleeve may cover the housing flow ports when the sleeve is in the lower position, thereby closing the housing flow ports and the sleeve may be clear of the flow ports when the sleeve is in the upper position, thereby opening the flow ports. In operation, surge pressure of the returns 47*r* generated by deployment of the LDA 9*d* and liner string 15 into the wellbore may be exerted on a lower face of the closed flapper. The surge pressure may push the flapper upward, thereby also pulling the sleeve upward against the compression spring and opening the housing flow ports. The surging returns 47*r* may then be diverted through the open flow ports by the closed flapper. Once the liner string 15 has been deployed, dissipation of the surge pressure may allow the spring to return the sleeve to the lower position.

Figure 7:
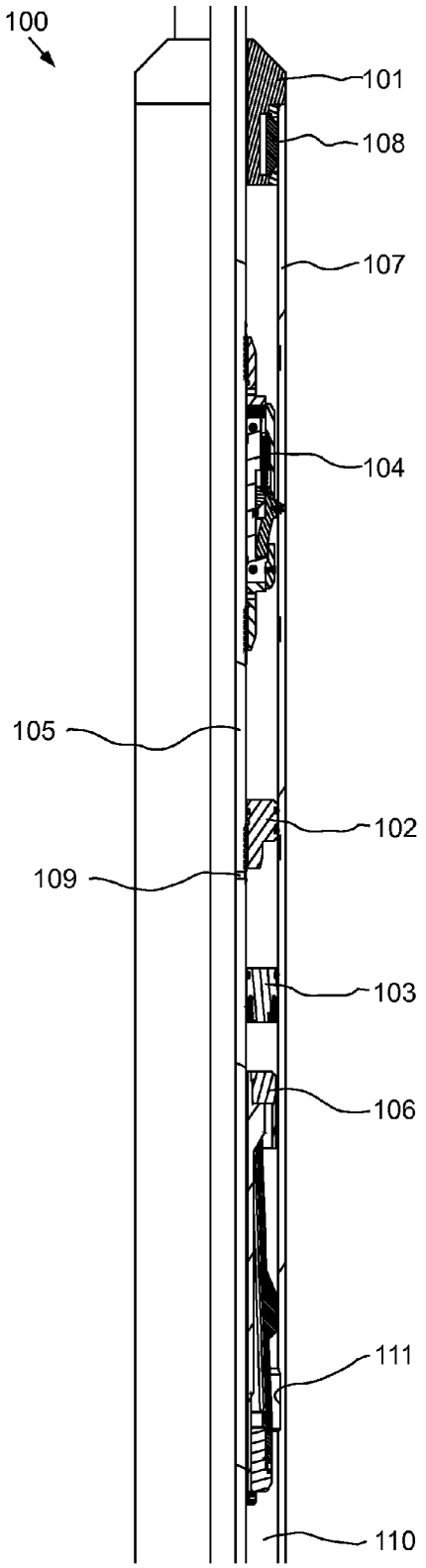
FIG. 7 illustrates an alternative setting tool, according to another embodiment of this disclosure.

FIG. 7 illustrates an alternative setting tool 100, according to another embodiment of this disclosure. The alternative setting tool 100 may be used with the LDA 9*d* in place of the setting tool 52. The alternative setting tool 100 may include a debris barrier 101, a packoff 102, a hanger actuator, such as piston 103, a packer actuator 104, a mandrel 105, and a latch, such as collet 106. An alternative PBR 107 may replace the PBR 15*r* of the liner string 15. Instead of being fastened to a latch profile of the PBR, the alternative debris barrier may have a gripper 108 for engaging an inner surface of the PBR 107 and a biasing member (not shown) urging the gripper 108 into engagement with the PBR. Since the mandrel actuation port 109 is located below the packoff 102, the need for a bypass passage and cylinder is obviated as a lower face of the actuator piston 103 is directly exposed to the surge chamber 110 and the actuation chamber may be formed between the mandrel 105 and the PBR 107. The PBR 107 may have a latch profile 111 formed in an inner surface thereof for engagement with the collet 106. The collet 106 may have a plurality of fingers and a detent sleeve movable relative to the fingers between an engaged position and a disengaged position.

In operation, pressured fluid may be supplied to an upper face of the actuator piston 103 via the mandrel port 109 (made possible by the seated ball). The piston 103 may slide downward and engage a top of the collet 106, pushing the collet 106 until fingers thereof engage with the PBR latch profile 111 and the detent sleeve is moved to an engaged position with the collet fingers, thereby transmitting a setting force from the piston 103 to the liner hanger. Once the liner hanger has been set, continued pumping may increase the pressure supplied to the piston 103 until a threshold pressure is reached. The collet 106 may be released from the latch profile 111 at the threshold pressure. The threshold pressure may be less than the required setting pressure of the packer. The piston may then push the collet 106 into engagement with a top of the running tool (not shown). To set the packer, the mandrel 105 is pulled upward and the running tool may move the detent sleeve back to the disengaged position. The packer actuator 104 may function in a similar fashion to the packer actuator 59.

Figure 8:
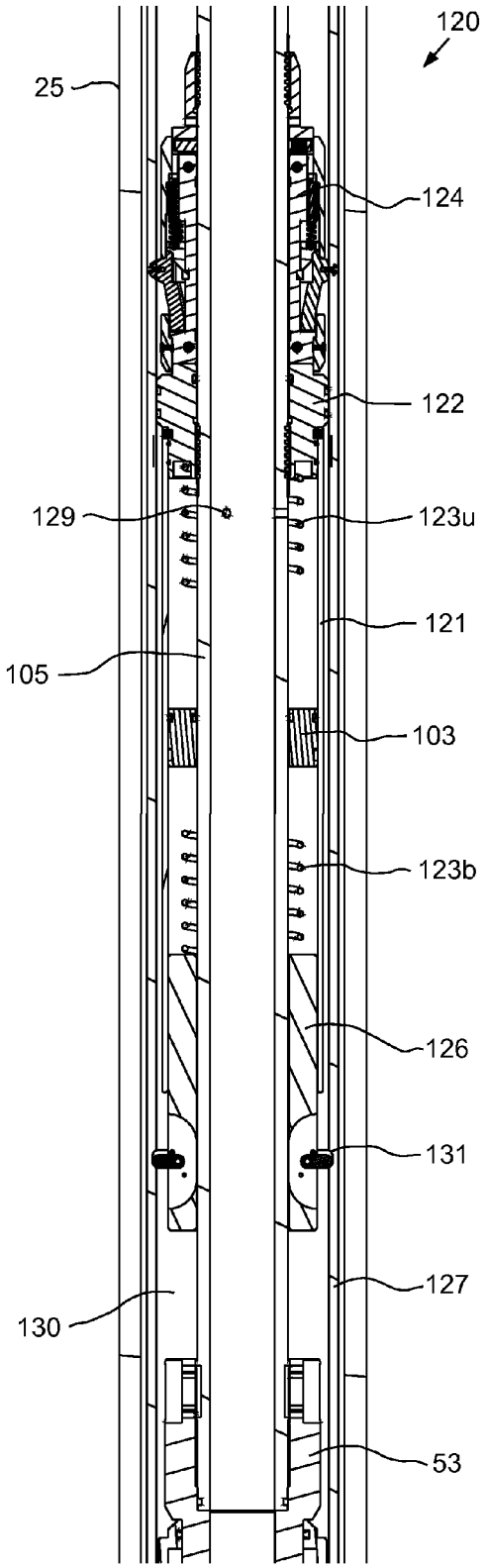
FIG. 8 illustrates an alternative setting tool, according to another embodiment of this disclosure.

FIG. 8 illustrates an alternative setting tool 120, according to another embodiment of this disclosure. The alternative setting tool 120 may be used with the LDA 9*d* in place of the setting tool 52. The alternative setting tool 120 may include the debris barrier 101, a cylinder 121, a packoff 122, one or more centralizer springs 123*u,b*, the piston 103, a packer actuator 124, the mandrel 105, and a latch 126. An alternative PBR 127 may replace the PBR 15*r* of the liner string 15. An upper end of the cylinder 121 may be connected to a lower end of the packoff 122, such as by fasteners.

An upper portion of the latch 126 may extend into a lower portion of the cylinder 121. Since the mandrel actuation port 129 is located below the packoff 122, the need for a bypass passage is obviated as an interface between the latch 126 and the cylinder 121 may be left unsealed, thereby providing fluid communication between the lower face of the actuator piston 103 and the surge chamber 130. The PBR 127 may have a latch groove 131 formed in an inner surface thereof for engagement with the latch 126. The latch 126 may include a body and a plurality of fasteners, such as pins, pivotally connected to the body. The latch pins may pivot relative to the body between an extended position (shown) and a retracted position (not shown). The latch may further include a plurality of stops for each pin, each stop engaging the respective pin in a respective position. The stops for engaging the pins in the extended position may be shearable fasteners operable to fracture at a threshold pressure exerted on the actuator piston. The pins may be engaged with the latch groove 131 in the extended position, thereby fastening the PBR 127 to the setting tool 120.

In operation, pressured fluid may be supplied to an upper face of the actuator piston 103 via the mandrel port 129 (made possible by the seated ball). The piston 103 may slide downward and engage and compress the lower spring 123*b*, thereby exerting a setting force on the latch 126. The latch 126 may transmit the setting force from the piston 103 to the liner hanger. Once the liner hanger has been set, continued pumping may increase the pressure supplied to the piston 103 until a threshold pressure is reached. The latch pin stops may fracture at the threshold pressure, thereby releasing the PBR 127 from the setting tool 120. The threshold pressure may be less than the required setting pressure of the packer. The piston 103 may then push the collet 106 into engagement with a top of the running tool 53. To set the packer, the packer actuator 124 may function in a similar fashion to the packer actuator 59.

While the foregoing is directed to embodiments of the present disclosure, other and further embodiments of the disclosure may be devised without departing from the basic scope thereof, and the scope of the invention is determined by the claims that follow.

The invention claimed is:

1. A setting tool for hanging a tubular string from a liner string, casing string, or wellhead, comprising:

a tubular mandrel having an actuation port formed through a wall thereof;

a debris barrier for engaging an upper end of the tubular string;

a piston disposed along the mandrel, having an upper face in fluid communication with the actuation port, and operable to stroke the debris barrier relative to the mandrel, thereby setting a hanger of the tubular string;

an actuator sleeve extending along the mandrel and connected to the piston;

a latch releasably connecting the debris barrier to the actuator sleeve and for releasably connecting the debris barrier to the tubular string;

a packoff connected to the mandrel below the piston and operable to seal against an inner surface of the tubular string, thereby forming a buffer chamber between the debris barrier and the packoff; and a passage in fluid communication with a lower face of the piston, formed in a wall of and along the mandrel, and bypassing the packoff.

2. The setting tool of claim 1, wherein:

the latch comprises a lock sleeve and a dog, the dog is disposed in an opening formed through a wall of the debris barrier and movable between an extended position and a retracted position, and the lock sleeve has a cam profile formed in an outer surface thereof for extending the dog.

3. The setting tool of claim 2, wherein the dog has an inner ring and a shearable fastener connected to the inner ring for engaging the tubular string.

4. The setting tool of claim 2, wherein:

the debris barrier has reamer blades formed in an upper face thereof, the cam profile has filter slots formed therethrough, the filter slots are in fluid communication with spaces formed between the reamer blades, thereby forming a vent passage from the buffer chamber.

5. The setting tool of claim 4, wherein:

the debris barrier has a fill passage formed therethrough closed by a plug, and the debris barrier has a relief passage formed therethrough closed by a rupture disk.

6. The setting tool of claim 2, wherein:

the lock sleeve has a load shoulder formed in an outer surface thereof for receiving a top of the debris barrier, the latch further comprises an inner shearable fastener connecting the lock sleeve to the actuator sleeve, and latch further comprises an outer shearable fastener connecting the debris barrier to the actuator sleeve.

7. The setting tool of claim 6, wherein:

the debris barrier has a slot formed through a wall thereof, the latch further comprises a pin carried by the lock sleeve and extending into the slot, and the slot has sufficient length to allow disengagement of the cam profile from the dog.

8. The setting tool of claim 7, wherein:

the mandrel has a slot formed in an outer surface thereof, the latch further comprises a second pin carried by the actuator sleeve and extending into the mandrel slot, and the inner shearable fastener longitudinally and torsionally connects the lock sleeve to the actuator sleeve.

9. The setting tool of claim 2, wherein:

the setting tool further comprises a cylinder connected to the mandrel, an actuation chamber is formed between the cylinder and the mandrel, and at least a portion of the piston is disposed in the actuation chamber and divides the chamber into an upper portion and a lower portion.

10. The setting tool of claim 9, wherein:

a bottom of the debris barrier has a torsion profile formed therein, an upper face of the cylinder has a torsion profile formed therein, and the torsion profiles are complementary, thereby being operable to torsionally connect the debris barrier and the cylinder.

11. The setting tool of claim 9, wherein a top of the cylinder is engageable with a bottom of the lock sleeve, thereby disengaging the cam profile from the dog.

12. The setting tool of claim 1, further comprising a packer actuator:

connected to the mandrel, operable between an extended position and a retracted position, for being restrained in the retracted position by being disposed in the tubular string, and extendable by being removed from the tubular string.

13. A deployment assembly for hanging a tubular string from a liner string, casing string, or wellhead, comprising:

the setting tool of claim 12 operable to set the hanger and a packer of the tubular string;

a running tool connectable to the setting tool, operable to longitudinally and torsionally connect the tubular string to an upper portion of the deployment assembly, and having a port providing fluid communication between the passage and a surge chamber;

a catcher connectable to the running tool and having a seat for receiving a setting plug; and a plug release system connectable to the catcher and comprising:

a wiper plug operable to engage the inner surface of the tubular string, thereby forming the surge chamber between the packoff and the wiper plug;

a launcher fastened to the wiper plug and operable to release the wiper plug in response to landing of a dart into the wiper plug; and a valve for relieving pressure from the surge chamber to a bore of the launcher.

14. The deployment assembly of claim 13, wherein:

the running tool comprises:

a tubular body connectable to the mandrel;

a latch for releasably connecting the tubular string to the body and comprising:

a longitudinal fastener for engaging a longitudinal profile of the tubular string; and a torsional fastener for engaging a torsional profile of the tubular string;

a lock keeping the latch engaged in the locked position;

a piston for releasing the lock and having a lower face in fluid communication with a bore of the running tool body and an upper face for being in fluid communication with the surge chamber;

a clutch for selectively torsionally connecting the torsional fastener to the body, and the latch is operable to release the debris barrier from the actuator sleeve after setting the liner hanger to allow relative longitudinal movement between the mandrel and the debris barrier in order to operate the clutch.

15. The deployment assembly of claim 13, wherein the catcher is operable to release the seat and the setting plug from a body thereof and move the seat and the setting plug into a capture chamber.

16. A system for hanging a tubular string from a liner string, casing string, or wellhead, comprising:

the deployment assembly of claim 13; and the tubular string comprising:

a polished bore receptacle (PBR) for engagement with the debris barrier;

a packer connected to the PBR and having a metallic gland carrying an outer seal and an inner seal and a wedge operable to expand the metallic gland;

a hanger having an upper portion connected to the packer;

a body carrying the hanger and packer and having a latch profile for engagement with the running tool; and a shearable fastener connecting the hanger upper portion to the body.

17. A method of hanging a tubular string from a liner string, casing string, or wellhead, comprising:

running the tubular string into a wellbore using a deployment string and a deployment assembly, wherein the deployment assembly comprises a seat and a setting tool having:

a debris barrier closing an upper end of the tubular string, a packoff sealing an interface between the setting tool and the tubular string, an actuator piston having an upper face in communication with a bore of the setting tool and a lower face in communication with the interface below the packoff, a latch releasably connecting the piston to the debris barrier and releasably connecting the debris barrier to the tubular string, and a packer actuator;

pumping a setting plug to the seat, thereby operating the piston to set a hanger of the tubular string, wherein the latch releases the debris barrier from the actuator piston after setting the hanger;

after setting the hanger, raising the setting tool from the tubular string, thereby operating the latch to release the debris barrier from the tubular string and extending the packer actuator against the upper end; and after raising the setting tool, setting weight on the packer actuator and upper end, thereby setting a packer of the tubular string.

18. The method of claim 17, wherein:

a buffer chamber is formed between the debris barrier and the packoff, and the latch has a filtered vent passage providing fluid communication between the buffer chamber and an annulus between the deployment assembly and the wellbore.

19. The method of claim 17, wherein:

the deployment assembly further comprises a running tool longitudinally and torsionally fastening the tubular string to the deployment string, and the running tool is unlocked in response to pumping the setting plug to the seat.

20. The method of claim 19, wherein:

the method further comprises releasing the running tool by lowering and then rotating the deployment string, and the debris barrier remains stationery while lowering the deployment string.

21. The method of claim 17, wherein:

a setting force of the packer is substantially greater than a setting force of the hanger, and setting of the hanger by the piston is transmitted through the packer.

22. The method of claim 17, wherein:

the deployment assembly further comprises a plug release system, the interface is a surge chamber formed between a wiper plug of the plug release system and the packoff, a valve of the plug release system opens to relieve pressure from the surge chamber in response to operation of the piston, and the method further comprises:

pumping cement slurry into the deployment string;

launching a dart into the deployment string;

pumping chaser fluid into the deployment string, thereby driving the dart and cement slurry through the deployment string and deployment assembly and seating the dart into a wiper plug of the plug release system.

23. The method of claim 17, further comprising retrieving the deployment assembly from the wellbore after setting the packer.

24. The method of claim 17, wherein:

the packoff is disengaged from the tubular string while raising the setting tool, the packoff is reengaged with the tubular string while setting the packer, and the method further comprises testing the packer by exerting pressure on an annulus between the deployment assembly and the wellbore.

25. A setting tool for hanging a tubular string from a liner string, casing string, or wellhead, comprising:

a tubular mandrel having an actuation port formed through a wall thereof;

a debris barrier for engaging an upper end of the tubular string;

a latch for engaging a profile formed in an inner surface of the tubular string and operable to release the tubular string in response to a threshold force;

a piston disposed along the mandrel, having an upper face in fluid communication with the actuation port, and operable to stroke the latch relative to the mandrel, thereby setting a hanger of the tubular string; and a packoff connected to the mandrel above the piston and operable to seal against the tubular mandrel and an inner surface of the tubular string, thereby forming a buffer chamber between the debris barrier and the packoff.

26. The setting tool of claim 25, wherein the latch comprises a collet and a detent sleeve.

27. The setting tool of claim 25, wherein the latch comprises a body, a plurality of pins pivotally connected to the body, and a shearable stop for each pin.

* * * * *